US006965367B2

(12) United States Patent
Tanaka et al.

(10) Patent No.: US 6,965,367 B2
(45) Date of Patent: Nov. 15, 2005

(54) DISPLAY

(75) Inventors: Yukio Tanaka, Kyoto (JP); Masanori Kimura, Osaka (JP); Takashi Okada, Osaka (JP); Katsuhiko Kumagawa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 243 days.

(21) Appl. No.: 10/108,299

(22) Filed: Mar. 28, 2002

(65) Prior Publication Data

US 2002/0149576 A1 Oct. 17, 2002

(30) Foreign Application Priority Data

Mar. 30, 2001 (JP) ..... 2001-098657

(51) Int. Cl.[7] ..... G09G 3/36
(52) U.S. Cl. ..... 345/102; 345/84; 345/94
(58) Field of Search ..... 345/30–111, 204–215; 315/307; 455/574; 362/559–561

(56) References Cited

U.S. PATENT DOCUMENTS

| | | | | |
|---|---|---|---|---|
| 5,412,396 A | | 5/1995 | Nelson | |
| 5,757,348 A | | 5/1998 | Handschy et al. | |
| 5,828,362 A | | 10/1998 | Takahashi et al. | |
| 6,111,559 A | * | 8/2000 | Motomura et al. | 345/102 |
| 6,119,023 A | * | 9/2000 | Tomiyori | 455/574 |
| 6,404,145 B1 | * | 6/2002 | Saito | 315/307 |
| 6,476,792 B2 | * | 11/2002 | Hattori et al. | 345/102 |
| 2002/0000960 A1 | | 1/2002 | Yoshihara et al. | |

FOREIGN PATENT DOCUMENTS

| | | |
|---|---|---|
| EP | 0749106 A2 | 12/1996 |
| JP | 3-163985 | 7/1991 |
| JP | 7-281647 | 10/1995 |
| JP | 10-268267 | 10/1998 |
| JP | 11-038386 | 2/1999 |
| JP | 11-119189 | 4/1999 |
| JP | 2000-275605 | 10/2000 |
| JP | 2001-290124 | 10/2001 |

* cited by examiner

*Primary Examiner*—Amr A. Awad
*Assistant Examiner*—Srilakshmi K Kumar
(74) *Attorney, Agent, or Firm*—McDermott Will & Emery LLP

(57) ABSTRACT

Disclosed is a display capable of improving uniformity of luminance and chroma in a plane of a display panel. When point at which the light source is turned ON is represented by T1, transmittance in a display region onto which the video signals are being written at the point T1 is represented by M1, point at which the light source is turned OFF is represented by T2, transmittance in the display region onto which the video signals are being written at point T2 is represented by M2, a maximum value of the transmittance in the display region of the light modulation element in a period during which the light source is ON is represented by M0, and the write period is represented by Twrite, the illuminating device control portion is adapted to control the illuminating device so as to satisfy a formula given by [|M2−M1|Twrite]/[M0(T2−T1)]≦0.92.

14 Claims, 14 Drawing Sheets

Twrite/2
Twrite/2 scan timing
time transmittance of liquid crystal display panel
time
Tlc
Tlc

ON luminance of light source (minimum width)
Tlum
time
T1
T2

ON luminance of light source
Tlum
time
T1
T2

ON luminance of light source (maximum width)
Tlum
time
T1
T2
Tsub scan timing
time
temperature θ 3
temperature θ 2
temperature θ 1 transmittance of liquid crystal display panel
temperature θ 3
temperature θ 2
temperature θ 1
time ON luminance of light source (temperature θ 1)
time
T1
T2

ON luminance of light source (temperature θ 2)
time
T1
T2

ON luminance of light source (temperature θ 3)
time
T1
T2

DISPLAY

FIELD OF THE INVENTION

The present invention relates to a display adapted to display an image by using light emitted from a light source. More particularly, the present invention relates to a display capable of turning ON/OFF the light source at appropriate timings.

DESCRIPTION OF THE RELATED ART

In recent years, active matrix type liquid crystal displays (hereinafter simply referred to as liquid crystal displays) have been widely used as displays for use in personal computers or the like from the viewpoint of space saving. The generalized method for color display conducted by the liquid crystal displays is a color filter method in which white light emitted from a light source is adapted to travel through color filters of three primary colors, i.e., red, green, and blue provided for respective pixels, thereby conducting color display. On the other hand, attention has been focused on a field sequential color method in which a plurality of light sources capable of emitting lights of different prisms are turned ON (lighted) by time division, thereby conducting color display, as a color display method for the liquid crystal displays for coming generation.

In the above-mentioned color filter method, since only a specific wavelength spectrum component is selectively transmitted and the other wavelength spectrum component is absorbed when the light emitted from the light source travels through the color filters, light availability efficiency is low. On the other hand, the field sequential color method has an advantage in that since the lights emitted from the light sources of the respective colors can be directly used for displaying image without traveling through the color filters, high light availability efficiency is achieved, and consequently, low power consumption becomes possible. The field sequential color method has a further advantage in that high definition is achieved because display is conducted for every pixel, although display is conducted for each set of three pixels respectively having red, green, and blue filters in the color filter method. Moreover, in the field sequential color method, cost is reduced because of absence of the color filters.

FIGS. 14A–14C are timing charts showing an example of display operation of the liquid crystal display according to the conventional field sequential color method. FIG. 14A shows timings at which scan signals are output to gate lines in a liquid crystal display panel. FIG. 14B shows change in transmittance in pixels on respective rows included in the liquid crystal display panel. FIG. 14C shows change in ON luminance (lighting luminance) of respective light sources of red, green, and blue. FIGS. 14A–14C illustrate that the liquid crystal display panel has N-row pixels and N-row gate lines corresponding to these pixels. The display operation illustrated here is similar to that described with reference to FIG. 12 or 13 as third embodiment in Publication of Unexamined Patent Application No. Hei. 11-119189.

As shown in FIGS. 14A–14C, one frame period of the video signals is divided into three sub-frame periods of respective colors (red sub-frame period, green sub-frame period, and blue sub-frame period). Further, these sub-frame periods are each divided into write period Ta, hold period Tb, and erase period Tc.

First of all, as shown in FIG. 14A, in the write period Ta, the scan signals are sequentially output to the gate lines on 1st to N-th rows, and according to timings of this output operation, video signals corresponding to red, green or blue are written onto pixels on the respective rows. Consequently, the liquid crystal in the pixels on the rows responds and transmittance of the liquid crystal display panel varies to have a value according to the video signals in such a manner that it gently rises as shown in FIG. 14B because a certain time is needed for reaching target transmittance due to viscosity of the liquid crystal.

Subsequently, in the hold period Tb, the scan signals are not output to the gate lines. Therefore, no signals are written onto the pixels and the video signals written in the write period Ta are held in the respective pixels.

Then, in the erase period Tc, in the same manner as the write period Ta, the scan signals are sequentially output to the gate lines on 1st to N-th rows, and according to timings of this output operation, video signals (reset signals) for returning the transmittance of the liquid crystal display panel to a predetermined value, i.e., resetting the written video signals, are written onto the pixels on the respective rows. Also, in this case, due to the viscosity of the liquid crystal, the transmittance of the liquid crystal display panel gently falls as shown in FIG. 14B. FIG. 14B illustrates that the transmittance is set to 0.

As shown in FIG. 14C, the respective light sources are adapted to be ON exclusively during the hold period Tb when the video signals are held in all the pixels of the liquid crystal display panel. Such operation is repeated In the respective sub-frame periods of red, green, and blue, thereby conducting color display.

In the above-mentioned display operation of the liquid crystal display, as should be understood from FIGS. 14A–14C, with regard to the pixels corresponding to the gate lines to which the scan signals are output relatively later, the light source is turned ON before the transmittance fully reaches its target value. Due to the fact that the luminance of output light is proportional to integral value of the transmittance in the period during which the light source is ON, there are generated so-called luminance gradient and chroma gradient which respectively exhibit difference in luminance and difference in chroma between the pixels associated with the gate lines to which the scan signals are output relatively earlier and the pixels associated with the gate lines to which the scan signals are output relatively later.

As a solution to avoid such luminance gradient or chroma gradient, the light source could be turned ON after the transmittance in the pixels corresponding to the gate line to which the scan signal is output lastly, i.e., the pixels on N-th row has become sufficiently stable. When the sub-frame period, the write period, and the response time of the liquid crystal are represented by Tsub, Twrite, and Tlc, respectively, the time Tlum during which the light source can be ON is given by:

$$Tlum = Tsub - (2Twrite + Tlc).$$

In this case, Tlum decreases with an increase in the response time Tlc of the liquid crystal, and luminance of the output light correspondingly decreases. Consequently, it is impossible to ensure sufficient brightness. In extreme cases, (2Twrite+Tlc) might be larger than Tsub (corresponding to the case where Tlc is larger than (Tsub−2 Twrite)). In such cases, it is impossible to turn ON the light source while keeping the transmittance in all the pixels included in the liquid crystal display panel stable, and therefore, display of image with uniform luminance and chroma becomes impossible.

As a further solution, the liquid crystal with sufficiently quick response, e.g., ferroelectric liquid crystal, could be used to reduce the response time Tlc. However, at low temperatures of not higher than 0° C., the response of such quick-response liquid crystal becomes extremely slow due to increased viscosity of the liquid crystal, which makes it impossible to prevent the generation of the luminance gradient or the chroma gradient. This problem is very serious, because, in particular, cellular telephones, portable terminals, and the like would be used outdoors in cold district. The ferroelectric liquid crystal involves a further problem that it is quick in response but less resistive to shock, and therefore, this liquid crystal is not suitable for use in the cellular telephones or the portable terminals. There has been proposed a method in which ON timings of the light source is shifted for every predetermined display region according to timings of output operation of the scan signals, as illustrated in the second embodiment disclosed in Publication of Unexamined patent application No. Hei 11-119189. This requires a plurality of regions for light emission and results in high fabricating cost.

SUMMARY OF THE INVENTION

The present invention has been made under the circumstances, and an object of the present invention is to provide a display capable of improving uniformity of luminance and chroma in a plane and ensuring sufficient brightness without an increase in fabricating cost.

Another object of the present invention is to provide a display capable of ensuring sufficient brightness while suppressing luminance gradient and chroma gradient even at low temperatures.

To achieve the above-described object, there is provided a display comprising: a light modulation element including light modulation medium interposed between a pair of opposed substrates and having a plurality of pixels for displaying an image; an illuminating device having a light source; a drive portion for driving the light modulation medium by sequentially repeating writing and erasing of video signals for each pixel group to thereby change transmittance of light emitted from the light source in the light modulation element; and an illuminating device control portion for controlling the illuminating device to cause the light source to be turned ON in the course of rising of transmittance in a pixel included in a pixel group onto which the video signals are being written at substantially intermediate time in a write period during which the video signals are written and the light source to be turned OFF in the course of falling of the transmittance in the pixel.

With such constitution, it is possible to ensure sufficient brightness for satisfactory display while suppressing luminance gradient and chroma gradient in the display region of the image.

In the display, the illuminating device control portion may be adapted to control the illuminating device to cause the light source to be turned ON in the course of rising or transmittance in a pixel included in a pixel group onto which the video signals are being written substantially at start point of the write period and the light source to be turned OFF in the course of falling of transmittance in a pixel included in a pixel group onto which the video signals are being written substantially at completion point of the write period.

This makes it possible to prevent mixed color in the field sequential color method and image retention and blur in a moving image in the blinking backlight method.

In the display, when point at which the light source is turned ON is represented by T1, transmittance in display region onto which the video signals are being written at the point T1 is represented by M1, point at which the light source is turned OFF is represented by T2, transmittance in display region onto which the video signals are being written at point T2 is represented by M2, a maximum value of the transmittance in the display region of the light modulation element in a period during which the light source is ON is represented by M0, and the write period is represented by Twrite, the illuminating device control portion may be adapted to control the illuminating device so as to satisfy a formula given by $$[|M2-M1|Twrite]/[M0(T2-T1)]\leqq 0.92.$$

Also, in the display, when response time of the liquid crystal is represented by Tlc, the illuminating device control portion is adapted to control the illuminating device so as to satisfy Tlc≧Twrite. This provides effects of suppressing the luminance gradient and chroma gradient noticeably.

In the display, one of the pair of substrates may be an array substrate having a plurality of gate lines and source lines arranged so as to cross each other; pixel electrodes respectively provided as corresponding to points at which the plurality of gate lines and the plurality of source lines cross each other; a plurality of switching devices respectively provided as corresponding to the pixel electrodes, for switching between a conductive state and a non-conductive state between the pixel electrodes and the source lines in accordance with a drive signal supplied through the gate lines, and the other of the pair of substrates may be an opposing substrate having a counter electrode disposed opposite to the array substrate.

The display may further comprise: a temperature sensor for measuring temperature of a vicinity of the light modulation element, and the illuminating device control portion may be adapted to control the illuminating device to cause the light source to be turned ON/OFF according to measurement obtained by the temperature sensor. This allows the light source to be ON-controlled at appropriate timings according to temperatures in environment where the display is used.

The display according may further comprise: a receiving portion for receiving an input for setting of ON timing of the light source, wherein the illuminating device control portion is adapted to control the illuminating device to cause the light source to be turned ON/OFF according to the setting indicated by the input received by the receiving portion. This makes it possible for a user to control for turning ON the light source at desired timings.

In the display, the light modulation medium may be liquid crystal. Since the liquid crystal is the least expensive and superior in productivity, the display of the present invention can be fabricated easily.

The liquid crystal of the display way be OCB-mode (Optically Self-Compensated Birefringence mode) liquid crystal.

Also, the light source may be light-emitting diode, or electroluminescence light-emitting element.

In the display, the illuminating device may have a light source for emitting lights of different prisms, one frame period of the video signals may be composed of a plurality of sub-frame periods, and the illuminating device control portion may be adapted to control the illuminating device to cause the light source for emitting light of a specified prism in the course of rising of the transmittance in the pixel included in the pixel group onto which the video signals are being written at substantially intermediate time in the write period and the light source to be turned OFF in the course of falling of the transmittance in the pixel in each sub-frame period. This constitution can realize the display or the present invention according to so-called field sequential color method.

In the display, one of the pair of substrates may have color filters of red, blue, and green, and the illuminating device control portion may be adapted to control the illuminating device to cause the light source to be turned ON in the course of rising of the transmittance in the pixel included in the pixel group onto which the video signals are being written at substantially intermediate time in the write period and the light source to be turned OFF in the course of falling of the transmittance in the pixel in each frame period of the video signals. This constitution can realize the display of the present invention according to so-called blinking backlight method.

According to the present invention there is also provided a cellular telephone comprising: the above-identified display, and the cellular telephone may be adapted to output video signals to the display.

According to the present invention, there is further provided a portable terminal comprising: the above-identified display, and the portable terminal may be adapted to output video signals to the display.

This object, as well as other objects, features and advantages of the invention will become more apparent to those skilled in the art from the following description taken with reference to the accompanying drawings.

BRIEF DESCRIPTION OF THE DRAWINGS

FIGS. 4A–4C are timing charts showing an example of display operation of the display of the first embodiment, in which FIG. 4A shows timings at which scan signals are output to gate lines in a liquid crystal display panel, FIG. 4B shows change in transmittance in pixels on respective rows included in the liquid crystal display panel, and FIG. 4C shows change in ON luminance of respective light sources of red, green and blue;

FIGS. 5A, 5B are explanatory views showing the ON timing of the light source, in which FIG. 5A shows change in transmittance of the liquid crystal display panel in a pixel on N/2-th row, and FIG. 5B shows change in ON luminance of the light source;

FIGS. 6A, 6B are explanatory views showing ON timing of the light source, in which FIG. 5A shows change in transmittance of the liquid crystal display panel in a pixel on N/2-th row, and FIG. 5B shows change in ON luminance of the light source;

FIGS. 7A–7E are explanatory views showing time during which the light source can continue to be ON in one sub-frame period, in which FIG. 7A shows timing at which the scan signal is output to the gate line on N/2-th row, FIG. 7B shows transmittance of the liquid crystal display panel in the pixel on N/2-th row, and FIGS. 7C–7E respectively show ON luminance of the light source;

FIGS. 8A–8C are explanatory views for explaining ON luminance of the light source in one sub-frame period, in which FIG. 8A shows that the ON luminance has a rectangular wave shape, FIG. 8B shows the ON luminance that gently varies, and FIG. 8C shows that the ON luminance has a plurality of pulses;

FIGS. 10A–10E are explanatory views showing ON timing of the light source in one sub-frame period, in which FIG. 10A shows timing at which the scan signal is output to the gate line on N/2-th row, FIG. 10B shows transmittance of the liquid crystal display panel in the pixel on N/2-th row, and FIGS. 10C–10E respectively show ON luminance of the light source;

FIGS. 12A–12C are timing charts showing an example of display operation of the display according to a fourth embodiment of the present invention, in which FIG. 12A shows timings at which scan signals are output to gate lines in the liquid crystal display panel, FIG. 12B shows change in transmittance in pixels on respective rows included in the liquid crystal display panel, and FIG. 12C shows change in ON luminance of the light source;

FIGS. 13A, 13B are views showing appearance of devices including the displays of the present invention, in which FIG. 13A shows a cellular telephone and FIG. 13B shows a portable terminal; and FIGS. 14A–14C are timing charts showing an example of display operation of a liquid crystal display according to the conventional field sequential color method, in which FIG. 14A shows timings at which the scan signals are output to the gate lines in the liquid crystal display panel. FIG. 14B shows change in transmittance in pixels on the respective rows included in the liquid crystal display panel, and FIG. 14C shows change in ON luminance of light sources of red, green and blue.

DETAILED DESCRIPTION OF THE PREFERRED EMBODIMENTS

Now, preferred embodiments of the present invention will be described with reference to accompanying drawings. Displays of the present invention are adapted to use a light modulation element for image display. Hereinbelow, by way of example, a liquid crystal display panel is used as the light modulation element.

(Embodiment 1)

Figure 1:
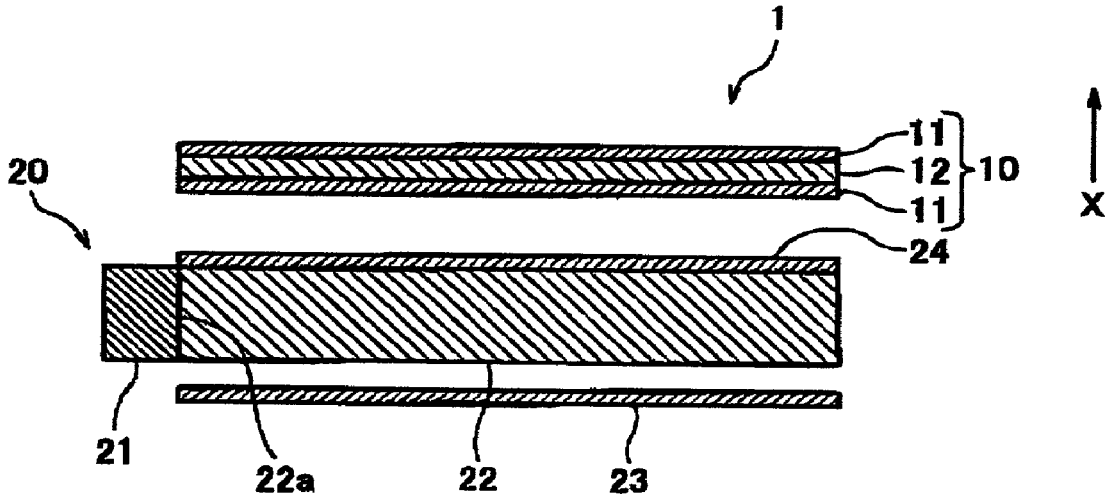
FIG. 1 is a cross-sectional view schematically showing a constitution of a display according to a first embodiment of the present invention.
Figure 2A:
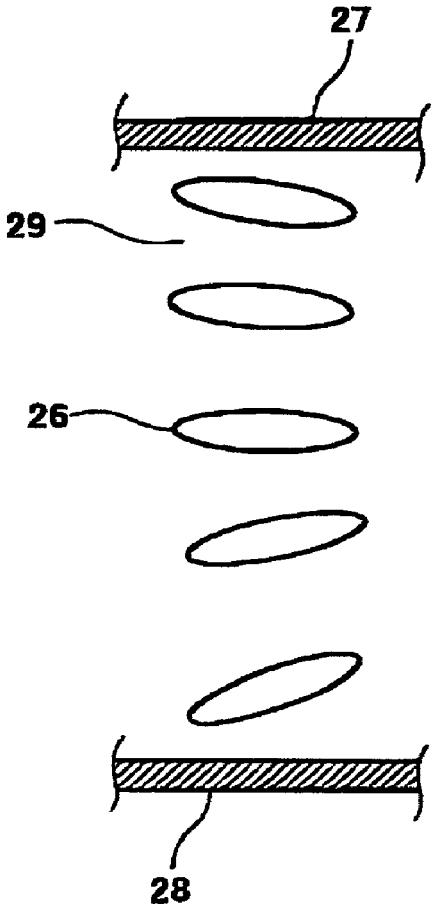
FIGS. 2A, 2B are cross-sectional views showing alignment states of liquid crystal filled in a liquid crystal layer included in the display according to the first embodiment.
Figure 2B:
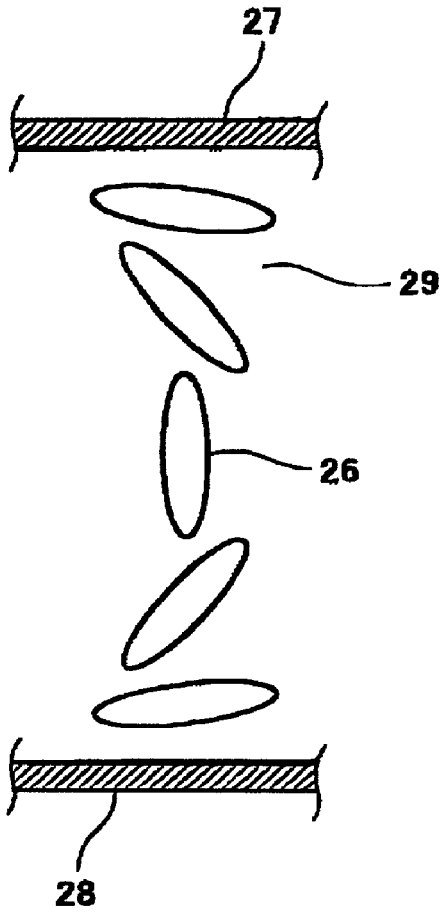

FIG. 1 is a cross-sectional view schematically showing a constitution of a display according to a first embodiment of the present invention. FIGS. 2A, 2B are cross-sectional views showing alignment states of liquid crystal filled in a liquid crystal layer included in the display according to the first embodiment. In these Figures, for the sake of convenience, a direction indicated by an arrow X indicates an upper side of a display 1.

Referring now to FIG. 1, the display 1 comprises a liquid crystal display panel 10 structured such that polarizers 11 are bonded to both sides of a liquid crystal cell 12. The liquid crystal cell 12 comprises two substrates, i.e., an upper substrate 27 and a lower substrate 28 disposed opposite to each other as spaced by a spacer (not shown) between them.

A liquid crystal layer 29 contains liquid crystal 26 filled Into a gap between the upper substrate 27 and the lower substrate 28.

The liquid crystal display panel 10 so constituted is so-called OCB-mode liquid crystal display panel, in which a given voltage is applied across the upper substrate 27 and the lower substrate 28 to cause the liquid crystal 26 to transition from spray alignment (FIG. 2A) to bend alignment (FIG. 2B), and in this bend alignment state, image is displayed.

A backlight 20 is placed below the liquid crystal display panel 10. The backlight 20 comprises a light guiding plate 22 comprised of transparent rectangular synthetic resin plate, a light source 21 placed in the vicinity of an end face 22*a* of the light guiding plate 22 as opposed to the end face 22*a*, a reflector 23 placed below the light guiding plate 22, and a light diffusing sheet 24 provided on an upper surface of the light guiding plate 22.

The light source 21 of the backlight 20 is comprised of LEDs (light-emitting diodes) or the like for emitting light of three primary colors—red, green, and blue. That is, the backlight 20 has the light source 21 for emitting lights of different prisms.

In this embodiment, thus, the backlight 20 has the light source 21 for emitting lights of three colors, i.e., red, green, and blue, but the colors are not intended to be limited to these. Alternatively, the backlight 20 may have a light source 21 for emitting lights of three colors of yellow, magenta, and cyan. It should be noted that for the purpose of natural color display, lights of three colors—red, green, and blue, are preferably used. Further, the number of the colors is not necessarily three but light of two or four or more colors may be used for color display. In brief, the light source capable of emitting light having different prisms is satisfactory.

As a matter of course, some of the plurality of light sources included in the backlight 20 may have the same prisms. For instance, two red light sources, two green light sources, and two blue light sources, i.e., six light sources in total may be provided.

The respective color lights may be lights near single wavelength like laser beam, or otherwise, may be lights having wide wavelength region generated by combination of color filters into a white light source. Since the light source 21 capable of being turned ON/OFF at a high-speed is desirable, the above-identified LED or electroluminescence (EL) light-emitting element is suitable. The electroluminescence light-emitting element include inorganic and organic EL light-emitting elements. Of course, the light source 21 may be comprised of a laser.

Further, the light source 21 itself may be adapted to perform switching operation between emission and non-emission, or otherwise may look like as if it were on/off-controlled by combination of light shutter, rotary color filter or the like into the light source which is always ON. The rotary color filter refers to a filter structured such that a circular filter is divided into three sector forms respectively provided with red, green and blue filters. The rotary color filter is adapted to be rotated in synchronization with frame periods for emitting lights of respective colors. Publication of Unexamined Patent Application No. Hei. 3-163985 discloses a projection type display using the rotary color filter. In that case, the combination of the light source and the light shutter or the rotary color filter correspond to a light source for blinking. From the viewpoint of light availability efficiency (or power consumption), it is desirable that the light source itself perform switching operation between emission and non-emission.

In the backlight 20 so constituted, the light emitted from the light source 21 is incident on the light guiding plate 22 through the end face 22*a*. The incident light is multiple-scattered inside of the light guiding plate 22 and emanates from the entire upper surface thereof. In this case, the light leaking downward from the light guiding plate 22 and incident on the reflector 23 is reflected by the reflector 23 and returned to the inside of the light guiding plate 22. The light emanating from the light guiding plate 22 is diffused by the light diffusing sheet 24 and the resulting diffused light is incident on the liquid crystal display panel 10. Thereby, the liquid crystal display panel 10 is entirely and uniformly irradiated with red, green, or blue light.

Figure 3:
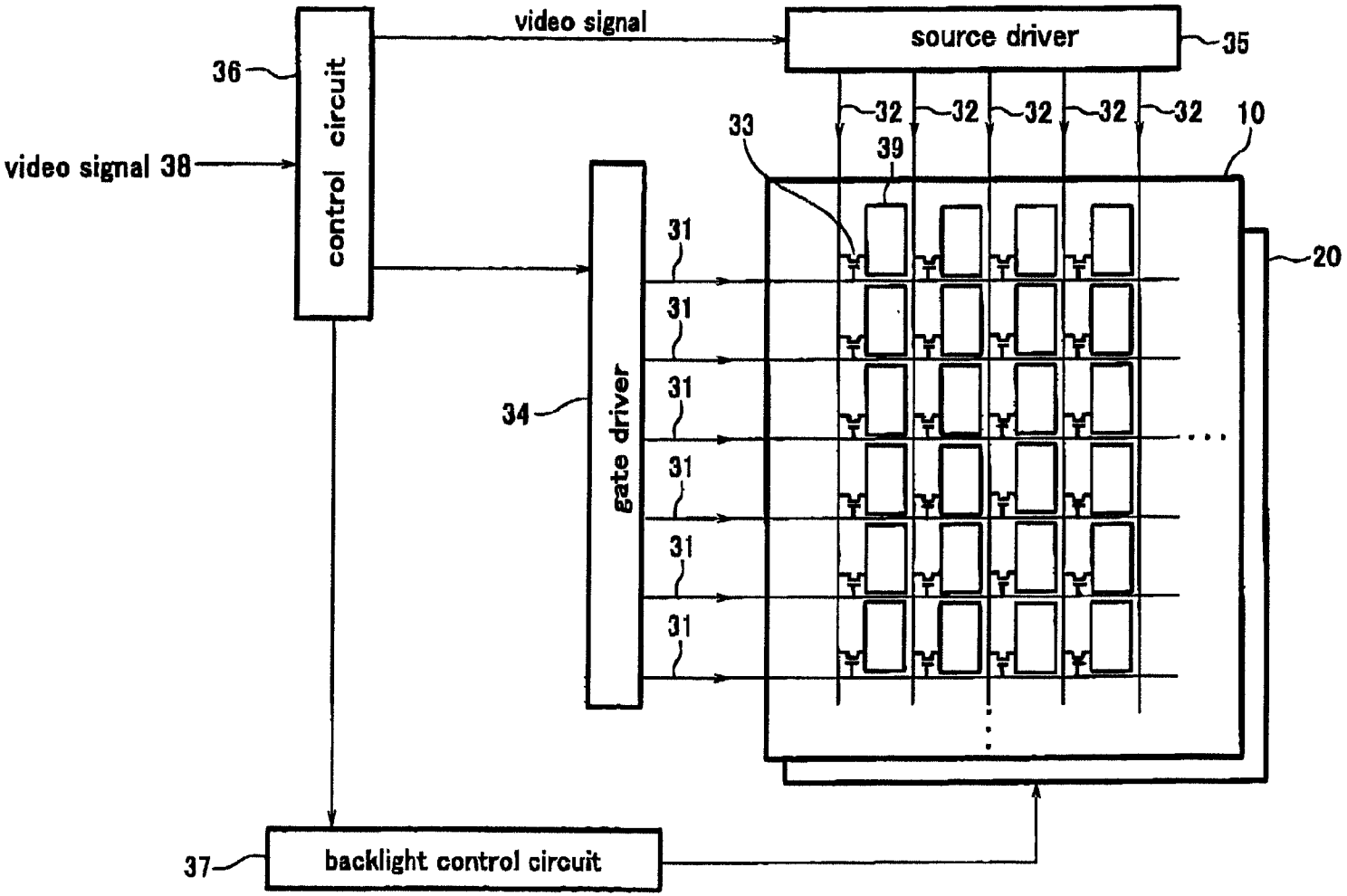
FIG. 3 is a block diagram showing a constitution of the display according to the first embodiment.

FIG. 3 is a block diagram showing a constitution of the display 1 according to the first embodiment. Referring to FIGS. 1, 2, 3, the liquid crystal display panel 10 is a well-known TFT (Thin Film transistor) type display panel comprised of an opposing substrate (not shown) provided with counter electrodes (not shown) on an inner surface thereof, and an array substrate (not shown) provided with pixel electrodes 39, gate lines 31, source lines 32, and switching devices 33 on an inner surface of thereof, which are disposed opposite to each other with the liquid crystal layer 29 interposed therebetween. In the array substrate, the gate lines 31 and the source lines 32 are arranged to cross each other, and the pixel electrode 39 and the switching device 33 are provided for every pixel defined by the gate lines 31 and the source lines 32. The gate lines 31 and the source lines 32 are respectively driven by a gate driver 34 and a source driver 35, which are controlled by a control circuit 36.

The switching devices 33 may be comprised of, e.g., amorphous silicon, polycrystal silicon, single crystal silicon, SOI (silicon on insulator), an organic semiconductor, or the like, or otherwise may be comprised of another devices so long as they have function for switching between conduction and non-conduction between the pixel electrodes 39 and the source lines 32, as mentioned later.

In the display 1 so constituted, the control circuit 36 outputs a control signal to a backlight control circuit 37 to cause the LEDs to sequentially emit respective color lights as the light source 21 in a given cycle. To perform display in synchronization with this light emission, the control circuit 36 also converts a video signal 38 externally input into a field sequential collar video signal (video signal compressed in time-axis direction for the purpose of displaying image in each sub-frame period). The control circuit 36 outputs the converted video signal to the source driver 35, and outputs control signals to the gate driver 34 and the source driver 35, according to the converted video signal. As a result, the gate driver 34 outputs scan signals to the gate lines 31, thereby sequentially turning on the switching devices 33 of the respective pixels to cause the pixel electrodes 39 and the source lines 32 to be conductive, and according to these timings, the source driver 35 sequentially writes the video signals onto the pixel electrodes 39 of the respective pixels through the source lines 32.

To be a greater detail, the gate driver 34 outputs the scan signal corresponding to voltage for turning on the switching devices 33 to the gate line 31 on 1st row, thereby turning on the switching devices 33 connected to the gate line 31 on 1st row. In this ON state, the video signals output from the source driver 35 to the respective source lines 32 are written onto the pixel electrodes 39 of the pixels on 1st row.

Then, the gate driver 34 outputs a signal corresponding to voltage for turning off the switching devices 33 to cause the pixel electrodes 39 and the source lines 32 to be non-conductive to the gate line 31 on 1st row, thereby turning off the switching devices 33 connected to the gate line 31 on 1st row. Simultaneously, the gate driver 34 outputs the scan signal to the gate line 31 on 2nd row, thereby turning on the switching devices 33 connected to the gate line 31 on 2nd row. Thereby, as in the case of 1st row, the video signals output from the source driver 35 to the respective source lines 32 are written onto the pixel electrodes 39 of the pixels on 2nd rows.

Thereafter, the same operation continues, and video signals are sequentially written onto the pixel electrodes 39 of the pixels on respective rows, which operation generates potential difference between the counter electrodes and the pixel electrodes 39, thereby causing the liquid crystal 26 to be driven and transmittance of the light emitted from the backlight 20 to be changed. As a result, image corresponding to the video signal 38 is observed by a viewer.

Subsequently, operation of the display 1 of this embodiment will be described.

Figures 4, 4A, 4B, 4C:
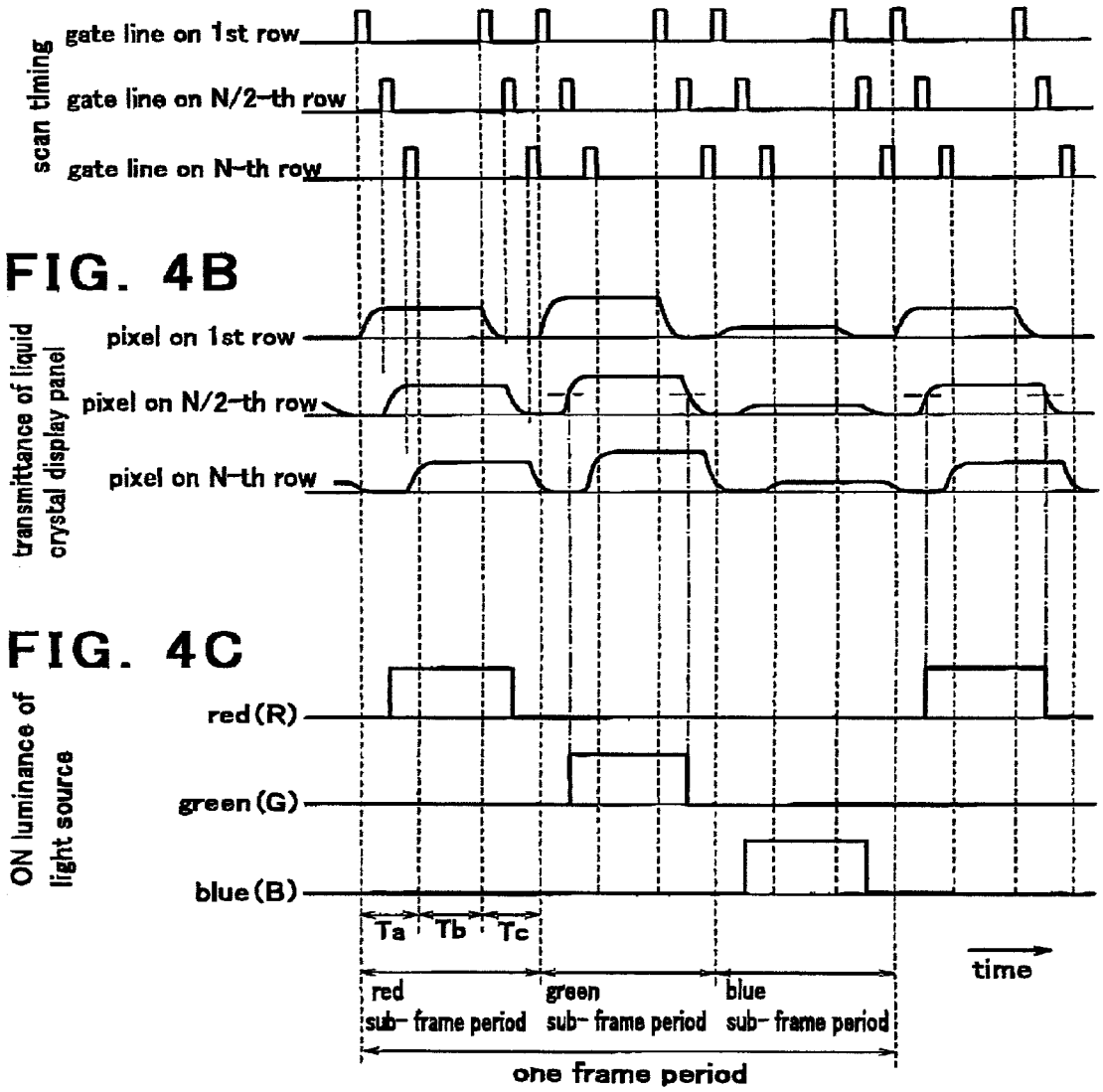

FIGS. 4A–4C are timing charts showing an example of display operation of the display of the first embodiment. FIG. 4A shows timings at which scan signals are output to gate lines in a liquid crystal display panel. FIG. 4B shows change in transmittance in pixels on respective rows included in the liquid crystal display panel. FIG. 4C shows change in ON luminance of respective light sources of red, green and blue. These Figures illustrate that the liquid crystal display panel has N-row pixels and N-row gate lines corresponding to these pixels.

As shown in FIG. 4A, the timings at which the scan signals are output are identical to those of the conventional example. Specifically, in the write period Ta, the gate driver 34 sequentially outputs the scan signals to the gate lines 31 on 1st to N-th row. According to timings of this output operation, the video signals corresponding to red, green or blue output from the source driver 35 to the source lines 32 are sequentially written onto the pixel electrodes 39 of the pixels on 1st to N-th row. Subsequently, in the hold period Tb, the scan signals are not output, and therefore, the video signals written in the write period Ta are held in the respective pixels.

Then, in the erase period Tc, similarly to the write period Ta, the scan signals are sequentially output to the gate lines 31 on 1st to N-th row and reset signals for resetting the video signals written in the write period Ta, are sequentially written onto the pixel electrodes 39 on 1st to N-th rows. FIG. 4B illustrates that the transmittance of the liquid crystal display panel 10 is set to 0.

According to such signal writing, the transmittance of the liquid crystal display panel 10 gently rises or falls as shown in FIG. 4B. As mentioned previously, the transmittance gently varies due to viscosity of the liquid crystal.

As shown in FIG. 4C, the backlight control circuit 37 controls the backlight 20 so that the light source 21 of the backlight 20 is turned ON (starts lighting) in the course of rising of the transmittance in the pixel on N/2-th row as a pixel onto which the video signals are being written at an intermediate time of the write period Ta and turned OFF (terminates lighting) in the course of falling of this transmittance. That is, the light source is turned ON before the completion of the rising of the transmittance and turned OFF after the start of the falling of the transmittance.

In this case, although it is recognized that the luminance gradient or chroma gradient would be generated in display region of the liquid crystal display panel 10, but the luminance gradient or the chroma gradient can be satisfactorily suppressed by setting appropriate ON timings. This will be described with reference to FIG. 5.

Figures 5A, 5B:
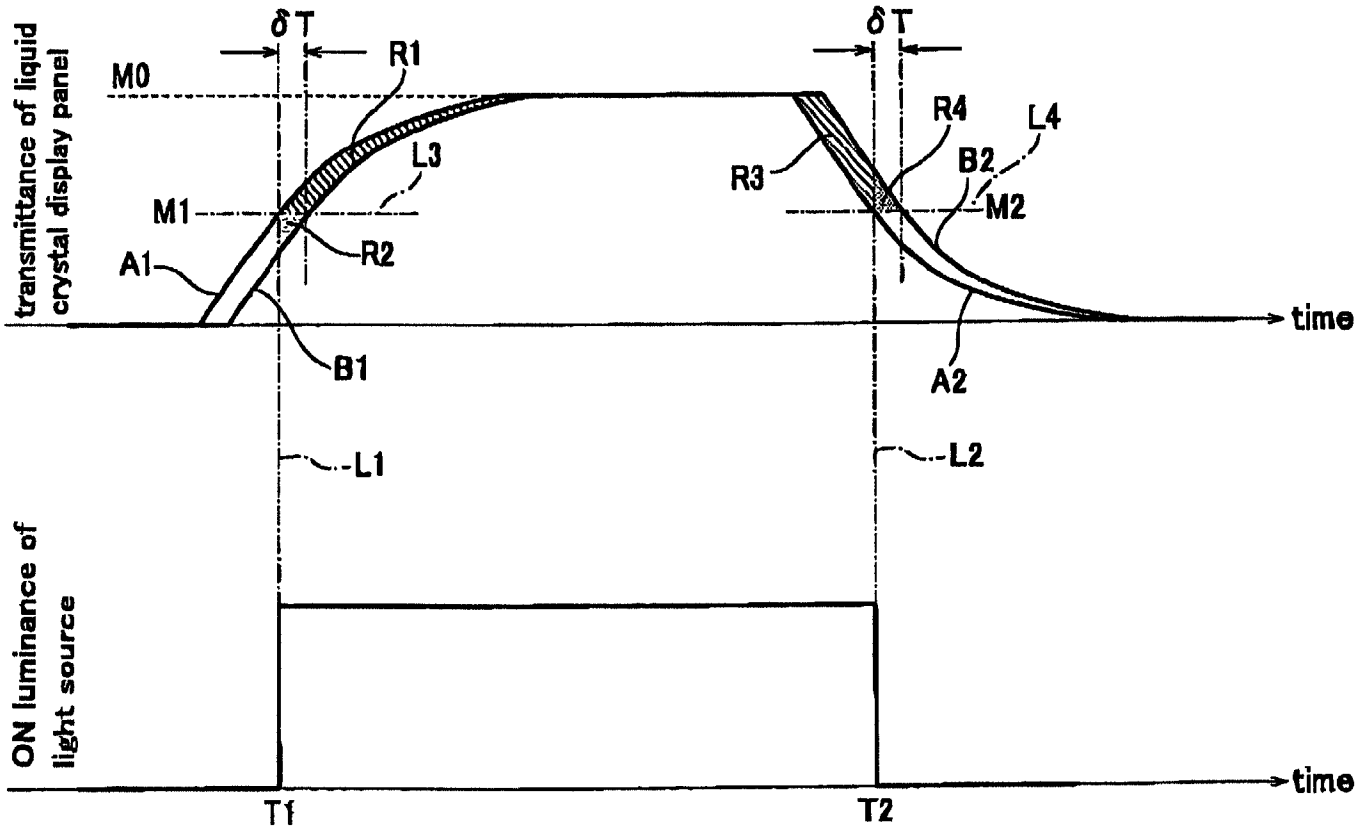

FIGS. 5A, 5B are explanatory views showing ON timing of the light source. FIG. 5A shows change in transmittance of the liquid crystal display panel in a pixel on N/2-th row. FIG. 5B shows change in ON luminance of the light source. In FIG. 5A, time-series change in the transmittance in the pixel on N/2-th row in an arbitrary sub-frame period is represented by waveform A1 and waveform A2, and time-series change in the transmittance with timings of writing of the video signals delayed by δT with respect to those of the waveforms A1, A2 is represented by B1, B2. ON point (lighting start point) and OFF point (lighting termination point) are represented by T1 and T2 respectively indicated by dashed lines L1, L2. The transmittance in the pixel on N/2-th row at point T1 and the transmittance in the pixel on N/2-th row at point T2 are respectively represented by M1, M2 and lines representing these transmittances M1, M2 are respectively represented by dashed lines L3, L4. Further, the transmittance in a stable condition, i.e., the largest transmittance in the sub-frame period is represented by M0.

Region defined by the waveforms A1, B1 and the line L3 is represented by R1 and region defined by the lines L1, L3, and the waveform B1 is represented by R2, while region defined by the waveforms A2, B2 and the line L2 is represented by R3 and region defined by the lines L2, L4, and the waveform B2 is represented by R4. When areas of the regions R1, R2, R3, R4 are respectively represented by S1, S2, S3, S4, difference δS in output luminance between the transmittance of A1, A2 and the transmittance of B1, B2 is given by δS=S3−(S1+S2). Hereinbelow, the value δS will be calculated.

First, with regard to the area S1 of the region R1, since the waveform B1 is obtained by horizontally moving the waveform A1 by δT, the horizontal width of the region R1 is equal to δT.

Therefore, the area S1 is given by:

$$S1=(M0-M1)\delta T$$

Second, with regard to the area S2 of the region R2, the region R2 is of a substantially right-angled triangle shape and the horizontal side length of the region R2 is equal to δT. When the slope of the waveform in the region R2 (value at point T1 of time differentiation of transmittance) is represented by $\mu 1$, the vertical side length of the region R2 is $\mu 1 \cdot \delta T$. So, the area S2 is given by:

$$S2=(1/2)\times\delta T\times\mu 1\cdot\delta T=(1/2)\mu 1(\delta T)^2$$

Third, with regard to the sum of the area S3 of the region R3 and the area S4 of the region R4, S3+S4=(M0−M2)δT, as in the case of the area S1 of the region R1, because the waveform B2 is also obtained by horizontally moving the waveform A2 by δT. Further, because the S4 is of substantially right-angled triangle shape as in the case of the area S2, $$S4=(1/2)|\mu 2|(\delta T)^2-(1/2)\mu 2(\delta T)^2$$

where $\mu 2$ is a time differential value of transmittance at T2. In summary, δs is given by the following formula (1):

$$\delta S=S3-(S1+S2)=(S3+S4)-S4-(S1+S2)=(M0-M2)\delta T+(1/2)\mu 2(\delta T)^2-[(M0-M1)\delta T+(1/2)\mu 1(\delta T)^2]$$

$$=(M1-M2)\delta T+(1/2)(\mu 2-\mu 1)(\delta T)^2 \quad (1)$$

Figures 6A, 6B:
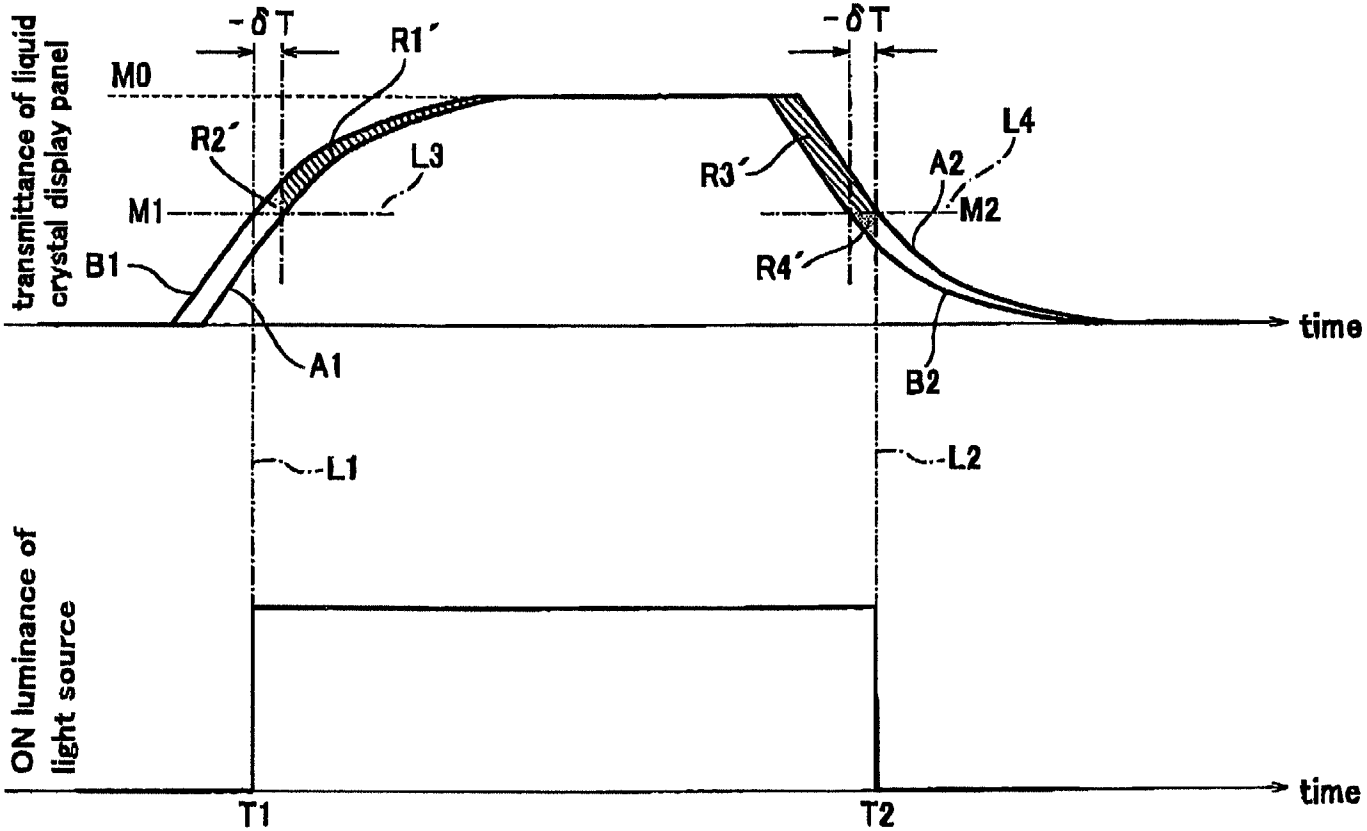

In the above example, the timings of writing of the video signals are later in the waveforms B1, B2 than in the waveforms A1, A2. Subsequently, the case where the timings of writing of video signals are earlier in the waveforms B1, B2 than in the waveforms A1, A2, will be described with reference to FIG. 6.

In FIG. 6, M0, M1, M2, T1, T2, L1–L4 represent the same contents in FIG. 5. Also, region defined by the waveforms B1, A1 and the line L1 is represented by R1' and region defined by the lines L1, L3, and the waveform B1 is represented by R2', while region defined by the waveforms A2, B2 and the line L4 is represented by R3' and region defined by the lines L2, L4, and the waveform B2 is represented by R4'. The areas of the regions R1', R2', R3', R4' are respectively represented by S1', S2', S3', S4'. The time difference of the waveforms B1, B2 with respect to the waveforms A1, A2, is represented by δT similarly to FIG. 5, Which has a negative value in FIG. 6.

Similarly to the case of FIG. 5.

$$S1'+S2'=(M0-M1)|\delta T|,\ S2'=(1/2)\mu 1|\delta T|^2,\ S3'=(M0-M2)|\delta T|,\ S4'=-(1/2)\mu 2|\delta T|^2$$

Therefore, the change amount δs of luminance of the waveforms B1, B2 with respect to the waveforms A1, A2, is given by the following formula (2):

$$\begin{aligned}\delta S=S1'-(S3'+S4')&=(S1'+S2')-S2'-(S3'+S4')=(M0-M1)|\delta T|-(1/2)\mu 1|\delta T|^2-[(M0-M2)|\delta T|-(1/2)\mu 2|\delta T|^2]\\&=(M2-M1)|\delta T|+(1/2)(\mu 2-\mu 1)|\delta T|^2=(M1-M2)\delta T+(1/2)(\mu 2-\mu 1)(\delta T)^2\end{aligned}\quad(2)$$

From the formulae (1), (2), it is known that the formulae (1), (2), are given in the same form, regardless of whether or not the waveforms B1, B2 are earlier than the waveforms A1, A2 in the center of the display region.

Subsequently, referring to FIG. 5, the ratio between the area S1 of the region R1 and the area S2 of the region R2 will be described. When the response time of the liquid crystal is represented by Tlc, it is considered that the slope $\mu 1$ of the waveform approximates M0/Tlc. Also, when the write period of the video signals is Twrite, the upper limit of |δT| is Twrite/2. S2/S1 for case where |δT|is the upper limit, is given by the following formula (3):

$$\begin{aligned}S2/S1&=[(1/2)\mu 1(\delta T)^2]/[(M0-M1)\delta T]\approx[(1/2)(M0-Tlc)(Twrite/2)^2]/[(M0-M1)Twrite/2]=(1/4)[M0/(M0-M1)](Twrite/Tlc)\end{aligned}\quad(3)$$

Here, assuming that transmittance M1 of the ON time T1 of the light source is almost as half as the largest transmittance M0, the write period Twrite is 1 msec, and the response time Tlc of the liquid crystal is 5 msec, S2/S1≈(1/4)×2 ×(1 msec/5 msec)=0.1, that is, S2 is one-digit smaller than S1. The same goes for S3 and S4 and S4 is one-digit smaller than S3. The same also goes for both of S1' and S2' and S3' and S4'. Taking these into account, in the lowermost expression of the formula (1) or (2), the first term associated with S1, S3 or S1', S3' is deemed to be more predominant than the second term associated with S2, S4 or S2', S4'. For this reason, the second term may be neglected in the formula (1) or (2), which is reduced to the following formula (4).

$$\delta s=(M1-M2)\delta T\quad(4)$$

Consider the case where the backlight 20 is controlled so that the transmittance M1 in the pixel on N/2-th row at point T1 when the light source is turned ON is equal to the transmittance M2 in the pixel at point T2 when the light source is turned OFF. In this case, in accordance with the formula (4), δS=0. This means that the luminance gradient and chroma gradient caused by the fact that the video signals are written at different timings are not generated in the liquid crystal display panel. The ON timing illustrated in FIG. 4C corresponds to this case.

The condition for perfectly eliminating the luminance gradient and the chroma gradient is M1=M2, and M1 (=M2) may fall in the range of 0–M0 so long as this condition is satisfied.

For the purpose of establishment of above-mentioned theory with reference to FIGS. 5, 6, as described above, it is essential that the following conditions [1], [2] should be satisfied in the pixel on N/2-th row.

[1] The light source is turned ON before completion of rising of the transmittance of the liquid crystal display panel in the pixel on N/2-th row.

[2] The light source is turned OFF after the start of falling of the transmittance of the liquid crystal display panel in the pixel on N/2-th row.

For added effects, it is desirable to satisfy the following conditions [3], [4] as well.

[3] The light source is turned ON after the start of rising of the transmittance of the liquid crystal display panel in the pixel on 1st row.

[4] The light source is turned OFF before completion of falling of the transmittance of the liquid crystal display panel in the pixel on N-th row.

The reason why it is desirable to satisfy the conditions [3], [4], is that the transmittance of the liquid crystal display panel in the pixel on 1st row might start rising before the completion of falling of the transmittance of the liquid crystal display panel in the pixel on N-th row, as can be seen from FIGS. 4A–4C, which might result in mixed color. For instance, in the case Where the transmittance of the liquid crystal display panel in a lower portion of the display region in a red sub-frame period has not completed falling yet at the point when the transmittance of the liquid crystal in the pixel on 1st row starts rising in a green sub-frame period, if the green light source is turned ON earlier than this point, green light is slightly emitted from the light source before the completion of the response of the liquid crystal in the pixel on N-th row to red. Also, in the case where the transmittance of the liquid crystal display panel in the pixel on 1st row in a blue sub-frame period has already started rising at the point when the transmittance of the liquid crystal display panel in the pixel on N-th row completes falling in a green sub-frame period, if green light source is turned OFF at point later than this point, then green light is slightly emitted from the light source before the completion of the response of the liquid crystal in the pixel on 1st row with respect to blue. In these cases, green light is mixed in the case where pure red or pure blue is intended to be displayed, and consequently mixed color is observed.

Furthermore, it is believed that, in the state of FIGS. 4A–4C, if the OFF timing of the red light source and the ON timing of the green light source are close to each other or the OFF timing of the green light source and the ON timing of the blue light source are close to each other, color breaking (e.g., phenomenon in which periphery of a white moving object in a screen is observed as colored) tends to occur, and the conditions [3], [4] are helpful in reducing such color breaking.

Figures 7A, 7B, 7C, 7D, 7E:
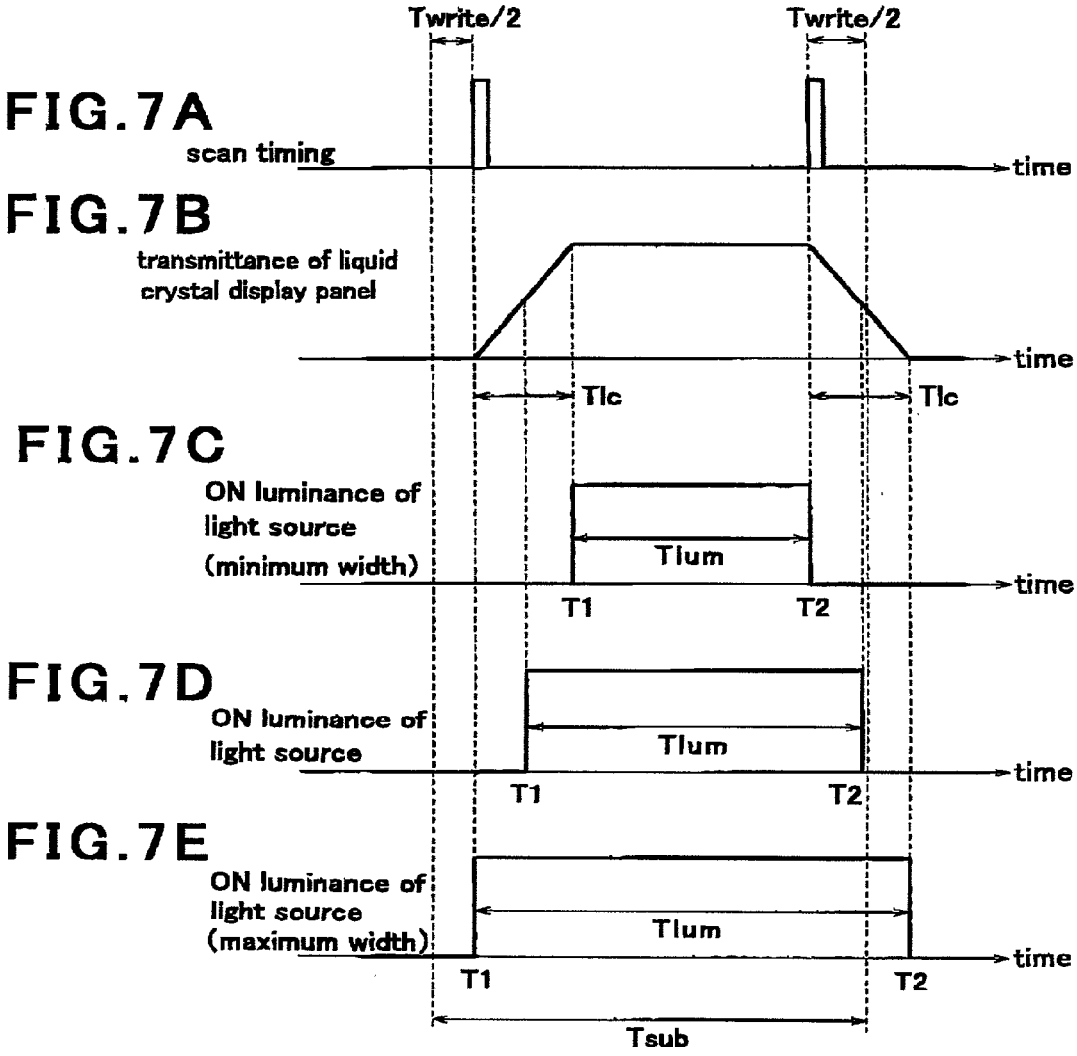

Subsequently, under the above-identified conditions, how long the light source can continue to be ON will be described. FIGS. 7A–7E are explanatory views for explaining time during which the light source continues to be ON in one sub-frame period. FIG. 7A shows timing at which the scan signal is output to the gate line on N/2-th row. FIG. 7B shows transmittance of the liquid crystal display panel in pixel on N/2-th row. FIGS. 7C–7E show ON luminance of the light source. FIG. 7C illustrates ON luminance in the case where M1 (=M2) is as close to M0 as possible. FIG. 7D illustrates ON luminance in the case where M1 is closer to M0/2. FIG. 7E illustrates ON luminance in a case where M1 is as close to 0 as possible.

As shown in FIG. 7A, the scan signal is output to the gate line 31 on N/2-th row after an elapse of Twrite/2 time from the start point of the sub-frame period, thereby causing the video signals to be written onto the pixel electrodes 39 of pixels on N/2-th row. Likewise, the scan signal is output to the gate line 31 on N/2-th row at the point that is Twrite/2 earlier than the end point of the sub-frame period, thereby causing the reset signals for resetting the video signals already written onto the pixel electrodes 39 of the pixels on N/2-th row to be written to the same pixel electrodes 39.

As shown in FIG. 7B, the transmittance of the liquid crystal display panel 10 in the pixel on N/2-th row:is rising for the response time Tlc of the liquid crystal from the point of writing of the video signals and is falling for the response time Tlc from the point of writing of the reset signals. In FIGS. 7A–7E, for the sake of simplicity, transient response of the transmittance of the liquid crystal display panel is linearly illustrated. While the rising time and the falling time are equal for added simplicity, these times may differ from each other, as a matter of course.

As shown in FIG. 7C. ON-time width Tlum (=T2−T1) of the light source is given by Tlum=TSub−Twrite−Tlc. Meanwhile, as shown in FIG. 7E, the ON-time width Tlum is larger than that of FIG. 7C, and is given by Tlum=Tsub−Twrite+Tlc. The ON-time width Tlum is the smallest in FIG. 7C and the largest in FIG. 7E. As shown in FIG. 7D, the ON-time width Tlum is given by Tlum=Tsub−Twrite, which is equal to an intermediate value between the value of FIG. 7C and the value of FIG. 7E.

As should be appreciated, even the smallest ON-time width Tlum, is larger than the upper limit (Tsub−(2Twrite+Tlc)) of ON-time width of the light source for obtaining uniform display in the conventional display. As a result, brighter image is obtained in the display of this embodiment than in the conventional display.

In the conventional display, as described above, the upper limit of the response width Tlc for obtaining uniform image without the luminance gradient and chroma gradient is Tsub−2Twrite. On the other hand, in this embodiment, as shown in FIG. 7C, the upper limit of the response width Tlc for obtaining the uniform image is Tsub−Twrite, which has an allowance greater than that of the conventional example. Accordingly, in this embodiment, at low temperatures, uniform display can be conducted with allowance even if the response of the liquid crystal is slow. In other words, in lower-temperature environment, uniform display without luminance gradient and chroma gradient can be achieved. Further, by turning ON the light source as shown in FIGS. 7D, 7E, brighter image is attained and the permissibility to the low temperatures can be further improved.

While it is the most desirable to adjust the ON timing and OFF timing so as to satisfy M1=M2, these timings may be set without perfect matching. Hereinbelow, such allowable difference will be described.

As shown in FIGS. 5A, 5B, 6A, 6B, the value of the output luminance at the central portion of the display region corresponds to the area of the portion between the points T1, T2 of the region defined by the waveforms A1, A2. In other words, the waveforms A1, A2, as a function of time, are integrated from the point T1 to point T2. Assuming that the transmittance is always M0 as rough approximate value between the points T1, T2, the area is given by M0 (T2−T1). Therefore, considering the above formula (4), relative luminance difference is given by:

$$|\delta S|/[M0(T2-T1)]=|(M1-M2)\delta T|/[M0(T2-T1)]$$

The upper limit of |δT| is Twrite/2, and therefore, the upper limit of the relative luminance difference is given by the following formula (5):

$$(1/2)[|M1-M2|Twrite]/[M0(T2-T1)] \quad (5)$$

The upper limit of |δT| is taken at an upper end or a lower end of the display region, and therefore, the value of the formula (5) is considered to represent [(luminance of pixel on 1st or N/2-th row)−(luminance of pixel on N/2-th row)]/(luminance of pixel on N/2-th row).

By the way, analysis is results (involving subjective evaluation) of the largeness of luminance ratio between the pixel on N/2-th row and the pixel on 1st or N-th row that is visually recognized by viewers as luminance gradient is stated in "Y. Kuratomi, et.al.: I D W'00 Proceedings of The Seventh International Display Workshops, 3Dp-2, pp. 1135–1138 (2000)". As described on page 1138, line 11–6 from bottom on left column, when the percentage of the luminance of the pixel on 1st or N-th row to the luminance of the pixel on N/2-th row is 54%, half of the viewers do not recognize it as the luminance gradient. This means that the relative luminance ratio (=|(luminance of the pixel on 1st or N-th row)−(luminance of the pixel on N/2-th row)|/(luminance of the pixel on N/2-th row)) is 46:100, and therefore, for preventing the luminance gradient from being recognized, the ON timings of the light source are determined so as to satisfy the following formula (6) or otherwise simplified formula (7).

$$(1/2)[|M1-M2|Twrite]/[M0(T2-T1)]\leqq 0.46 \quad (6)$$

$$[|M1-M2|Twrite]/[M0(T2-T1)]\leqq 0.92 \quad (7)$$

By setting the value of the left side [|M1−M2|Twrite]/[M0 (T2−T1)] of the formula (7) to less than 0.92, more than half of viewers do not recognize the luminance gradient. It is more preferable that the value of the left side of the formula (7) is set to 0.46 or less (formula 6).

From the fact that luminance gradient with the luminance ratio of 54:100 is not detected by half of the viewers, it is known that visual detecting ability of the human beings with respect to the luminance gradient in the display region is not so high. Conversely, the visual detecting ability with respect to the chroma gradient is considered to be slightly higher. For instance, if a single-color image obtained by mixing of three primary colors of red, blue, and green is displayed and 10% in-plane gradient is given only to the luminance of green component, then the chroma gradient might be recognized. Accordingly, to be more strict, it is more preferable that the left side of the formula (6) is set to 0.1 or less and the left side of the formula (7) is set to 0.2 or less.

As supplementary explanation, the relationship between the response time Tlc and the write period Twrite of the liquid crystal will be described in more detail. Previously, when the formula (4) as an approximate formula is derived from the formula (1) (or formula (2)), the second term of δT in the formula (1) has been neglected. When M1=M2 is set for the purpose of suppressing the luminance gradient and the chroma gradient, δS=0 when the second term of δT is neglected, but only the second term of δT remains on the formula (1) of δS when the second term of δT is not neglected for precision. Compared to the first term of δT, the indication indicative of the size of the second term of δT is S2/S1 in the formula (3), and the smaller S2/S1 is, the smaller than the second term of δT is, and therefore, the smaller the luminance gradient and the chroma gradient are. Since the formula (3) involves the factor of Twrite/Tlc, the larger Tlc is than Twrite, the more noticeable effects of suppressing the luminance gradient and chroma gradient is obtained.

Here, as a rough standard, the condition under which the influence by the second term is half or less of the influence by the first term, i.e., S2/S1 becomes ½ or less in the formula (3), will be found. For simplicity, assuming that M1 is as half as M0, the condition is expressed as Twrite/Tlc≦1. i.e., Twrite≦Tlc. Under Twrite≦Tlc, the luminance gradient and chroma gradient can be noticeably suppressed.

The point at which the transmittance of the liquid crystal display panel starts rising is considered to be the point at which the transmittance exceeds 10% of the maximum value M0 in the corresponding sub-frame period. Also, the point at which the transmittance of the liquid crystal display panel completes rising is considered to be the point at which the transmittance exceeds 90% of the maximum value M0 in the corresponding sub-frame period. Likewise, the point at which the transmittance of the liquid crystal display panel starts falling is considered to be the point at which the transmittance become below 90% of the maximum value M0 in the corresponding sub-frame period. Also, the point at which the transmittance of the liquid crystal display panel completes falling is considered to be the point at which the transmittance becomes below 10% of the maximum value M0 in the corresponding sub-frame period.

As mentioned previously, the elapsed time (rising time) from when the transmittance of the liquid crystal display panel starts rising until it completes rising may be set larger or smaller than, or otherwise equal to the elapsed time (falling time) from when the transmittance starts falling until it completes falling. If the rising time and the falling time differ from each other, then these times are averaged by calculation and set as the response time (Tlc).

Figure 8A:
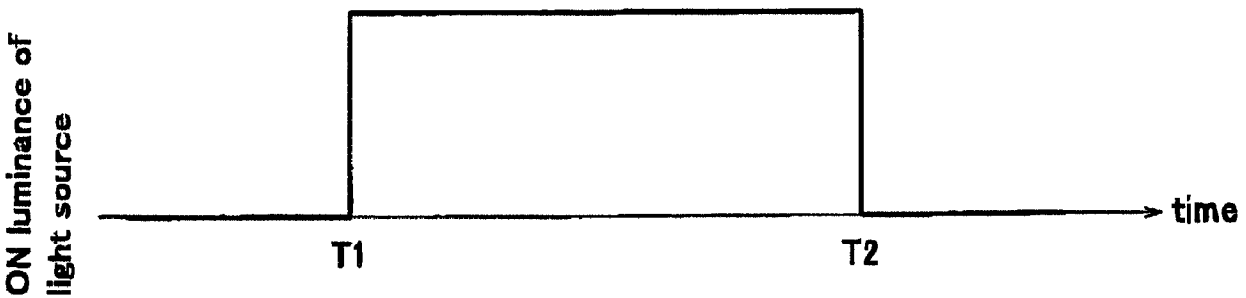
Figure 8B:
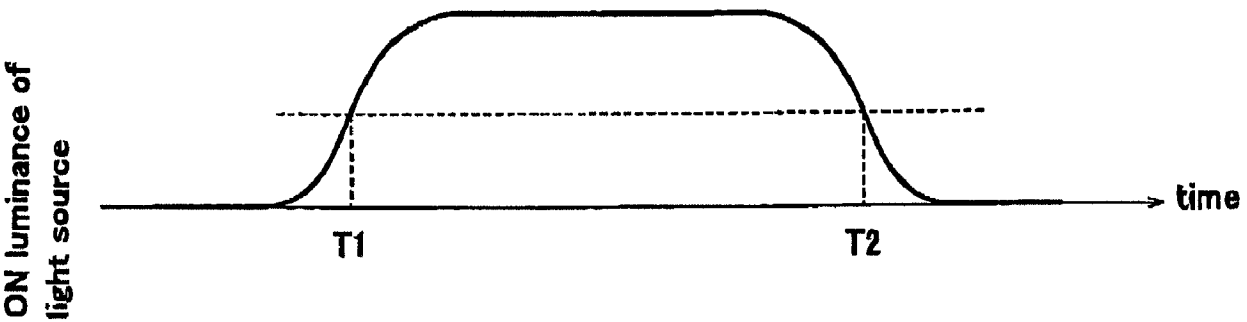
Figure 8C:
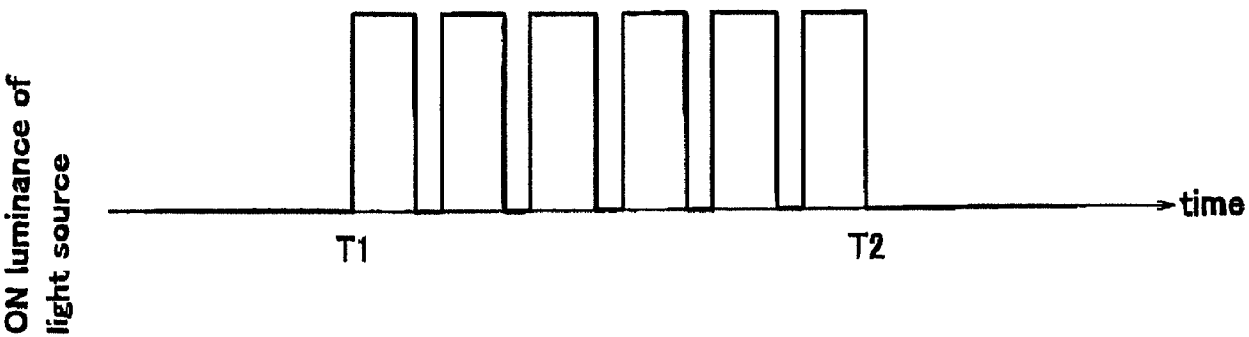

The ON luminance of the light source is not intended to be limited to be of the rectangular wave shape of FIG. 8A as illustrated in this embodiment For instance, the ON luminance may gently rise and fall as shown in FIG. 8B. In this case, the point at which the ON luminance exceeds ½ of the maximum value in the corresponding sub-frame period is considered to be the ON point of the light source and the point at which the ON luminance becomes below ½ of the maximum value is considered to be OFF point of the light source. Further, a shown in FIG. 8C, one sub-frame period may include a plurality of ON pulses. In that case, the rising of the initial ON pulse is considered to be the ON point (lighting start point) of the light source and the falling of the last pulse is considered to be the OFF point (lighting termination point) of the light source. In FIGS. 8A–8C, the points indicated by T1 are the ON points of the light source and the points indicated by T2 are the OFF points of the light source.

(Embodiment 2)

A second embodiment illustrates a display adapted to control ON timings of a light source according to temperatures.

Figure 9:
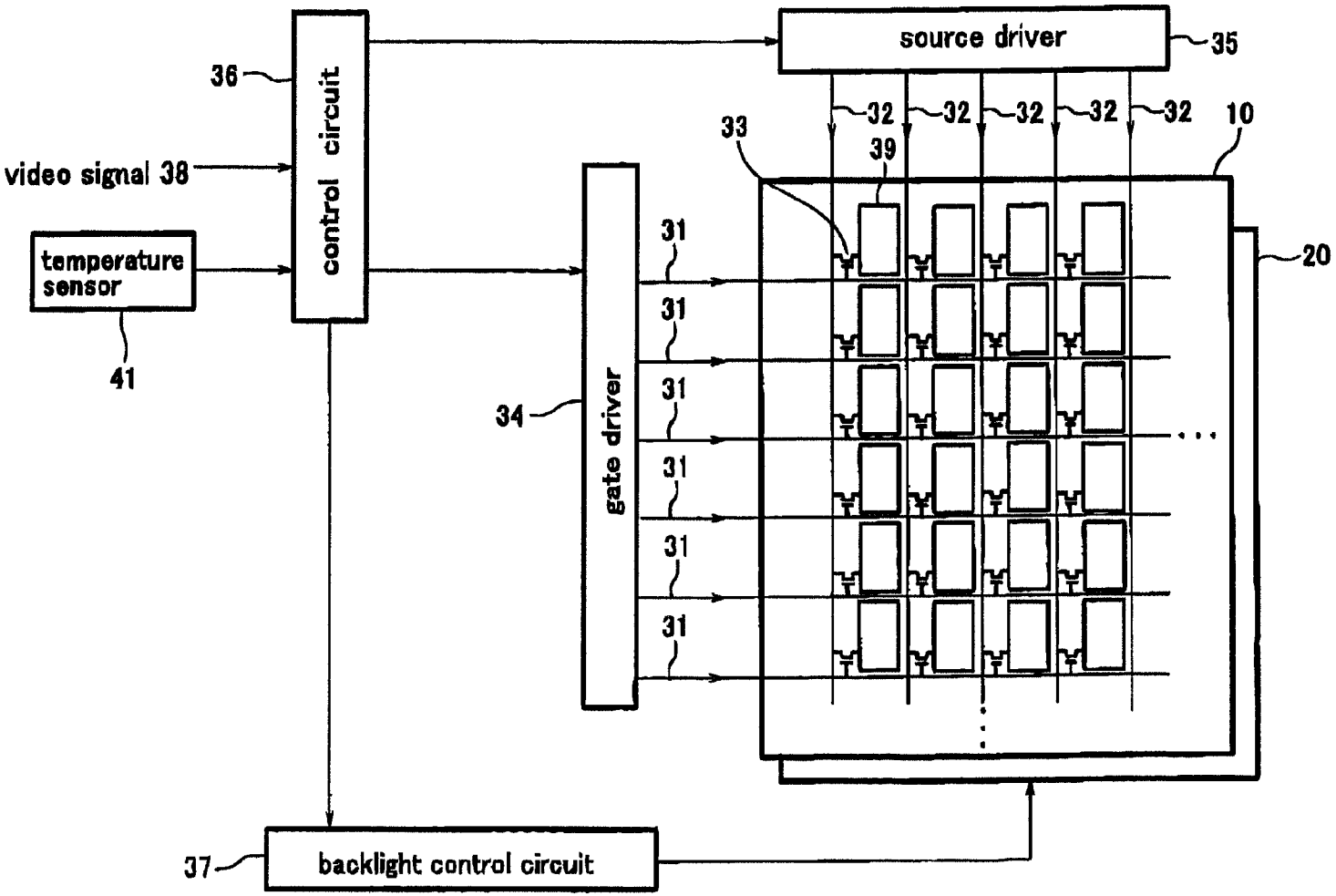
FIG. 9 is a block diagram showing a constitution of a display according to a second embodiment of the present invention.

FIG. 9 is a block diagram showing a constitution of a display according to the second embodiment of the present invention.

Referring to FIG. 9, the display of this embodiment comprises a temperature sensor 41 connected to a control circuit 36. The temperature sensor 41 is provided on the liquid crystal display panel 10 for detecting temperatures of the liquid crystal. The sensor 41 maybe provided at any position where it can detect the temperatures of the liquid crystal. The temperature sensor 41 may be comprised of a collecting sensor utilizing electricity collecting effects, thermocouple, or the like utilizing thermoelectric effects. Or otherwise, the temperature 41 may be comprised of a semiconductor device utilizing change in electric property such as resistance according to temperatures, an insulator, a metal, or an infrared ray sensor for detecting radiation spectrums.

Since the other elements of the display of the second embodiment are identical to those of the first embodiment, the same or corresponding parts are referenced by the same numerals and as such, description will be omitted.

Subsequently, operation of the display will be described.

In the display of this embodiment, as in the case of the first embodiment, the video signals are sequentially written onto the display region of the liquid crystal display panel 10 from the upper portion to the lower portion, and in accordance with this writing operation, transmittance in the display region varies.

Figures 10A, 10B, 10C, 10D, 10E:
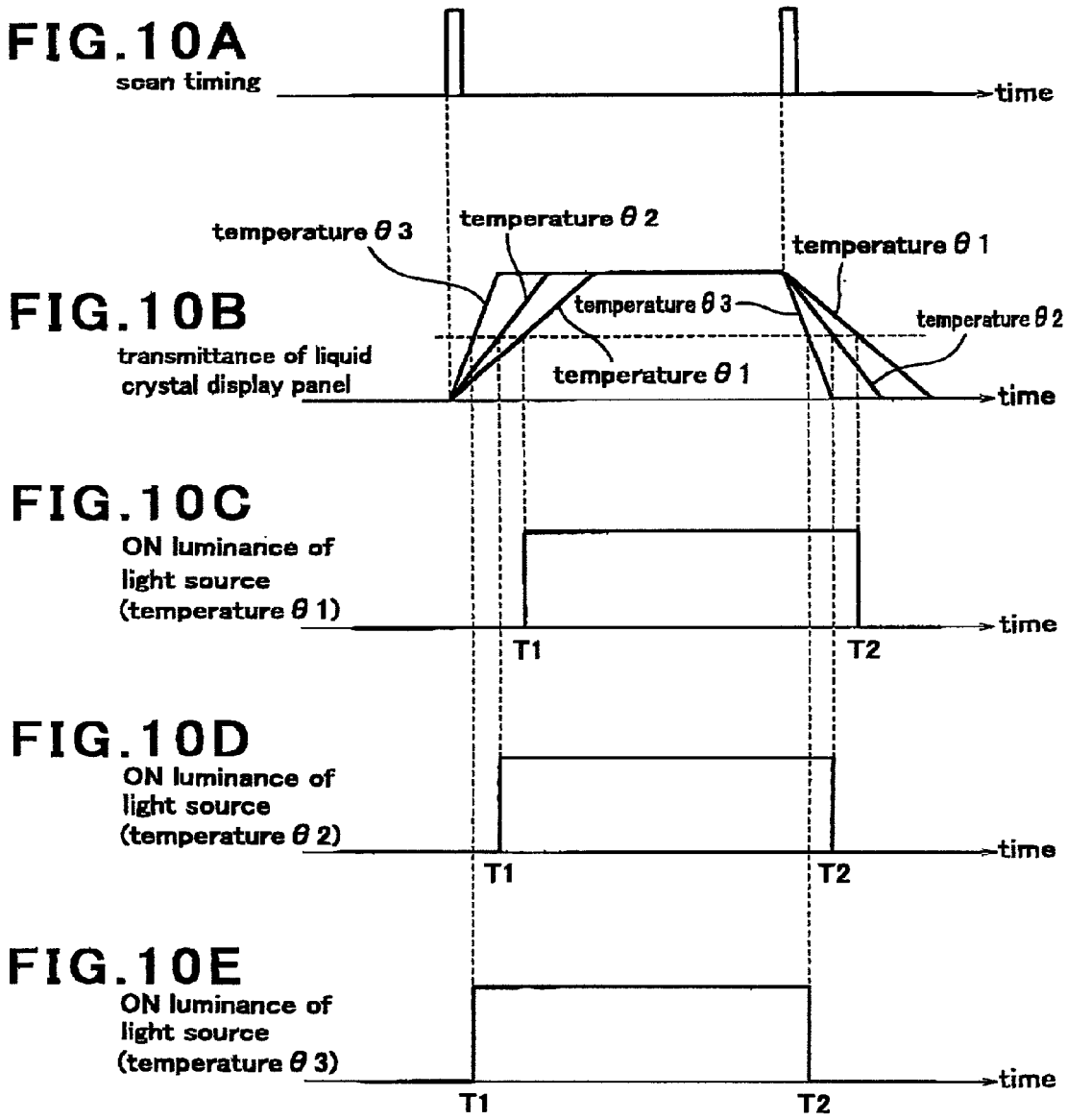

In such display operation, the backlight control circuit 37 of the display of this embodiment is adapted to control the backlight 20 to cause the light source to be turned ON at timings described below. FIGS. 10A, 10B are explanatory views showing timings at which the light source is turned ON in one sub-frame period. FIG. 10A shows timing at which the scan signal is output to the gate line on N/2-th row. FIG. 10B shows transmittance of the liquid crystal display panel in the pixel on N/2-th row. FIGS. 10C–10E respectively show ON luminances of the light source.

FIG. 10B illustrates change in the transmittances of the liquid crystal display panel 10 when the temperatures measured by the temperature sensor 41 are Θ1, Θ2, Θ3 (Θ1<Θ2<Θ3). As mentioned previously, since the response of the liquid crystal generally becomes slower as the temperature decreases, the response time (rising time, and falling time) is the shortest in Θ3 and increased in the order of Θ3, Θ2, Θ1. The light source is turned ON/OFF at timing of FIG. 7C in the case of Θ1, at timing of FIG. 7D in the case of Θ2, and at timing of FIG. 7E in the case of Θ3. Thus, by performing control to shift the ON/OFF timings of the light source according to the temperatures measured by the temperature sensor 41, the condition (M1=M2) for uniform display (display without luminance gradient or chroma gradient) can be satisfied and satisfactory display can be achieved at any temperature as in the case of the first embodiment.

It should be noted that sufficiently uniform display is attained so long as the formula (7) is satisfied at respective temperatures without the condition M1=M2. So long as the formula (7) is satisfied, one of the ON and OFF timings of the light source can be changed according to temperatures.

The temperature sensor 41 is not provided in the first embodiment, which does not mean that the display of the first embodiment cannot deal with temperature change at all in practice. The display without the temperature sensor 41 can attain uniform display with the formula (7) satisfied when the temperature change falls in a certain range. Therefore, the addition of the temperature sensor 41 to the display like this embodiment can greatly extend available temperature range.

While in this embodiment, the backlight control circuit 37 performs electronic control, this is only illustrative. Alternatively, a control portion for controlling the backlight 20 may be provided with a material having electric resistance varying according to temperatures. With this constitution, RC time constant comprised of this resistance R and a certain capacitance C is varied, thereby allowing the light source to be ON-controlled as shown in FIG. 10. In that case, the material having resistance increasing with temperature decrease is employed.

While in this embodiment ON and OFF timings of the light source are delayed according to the temperature decrease, as a matter of course, the same effects can be provided by putting forward the timings at which the control circuit 36 outputs the control signals to the gate driver 34 and the source driver 35 with temperature decrease, without change in ON and OFF timings of the light source.

Moreover, the ON/OFF timings of the light source may be changed according to any other conditions including moisture, ambient brightness, air-pressure, weather, earth magnetism, etc, instead of the temperatures described in this embodiment.

(Embodiment 3)

A third embodiment illustrates a display adapted to allow ON and OFF timings of the light source to be set by a user.

Figure 11:
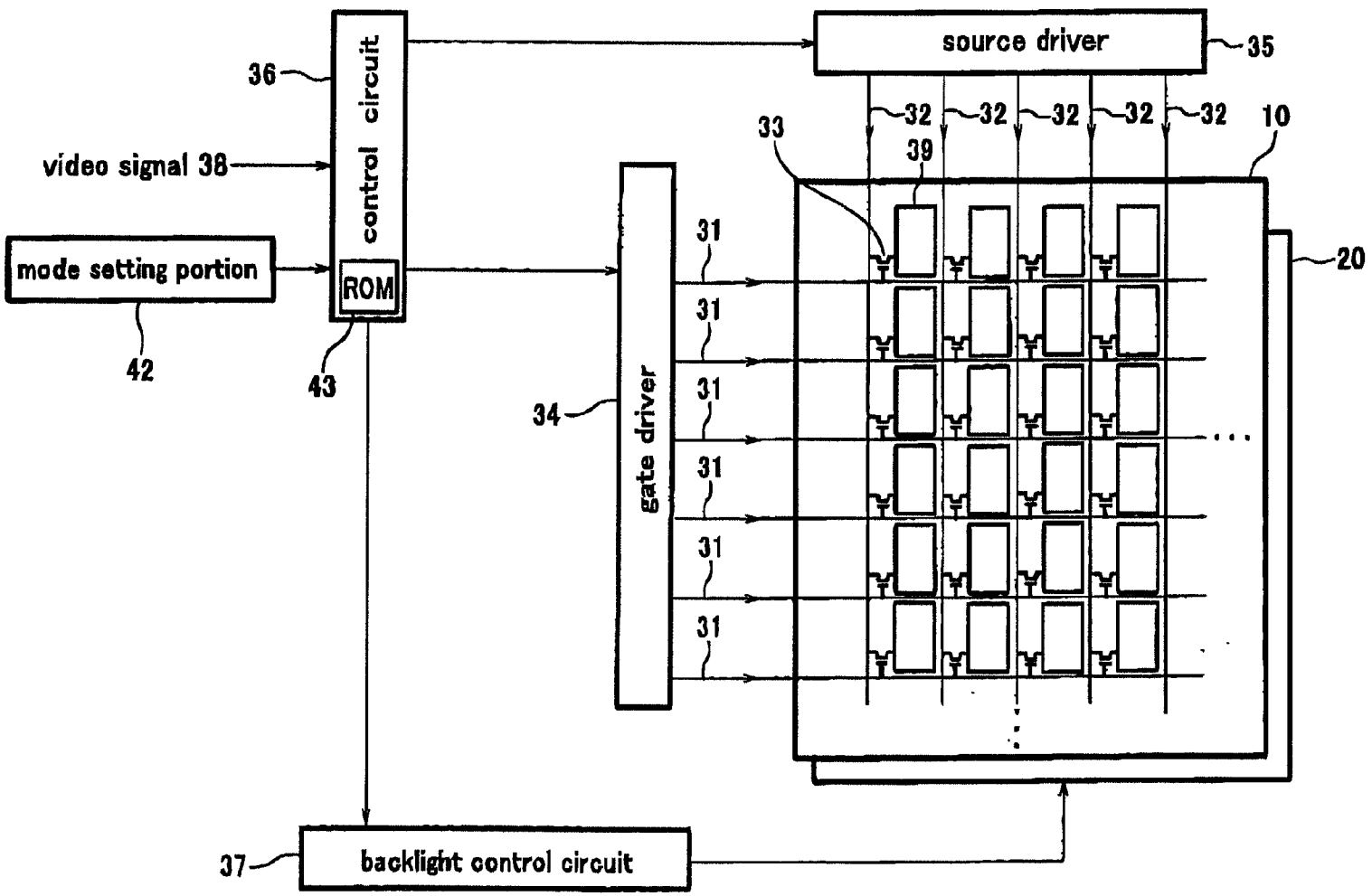
FIG. 11 is a block diagram showing a constitution of a display according to a third embodiment of the present invention.

FIG. 11 is a block diagram showing a constitution of a display according to a third embodiment of the present invention. Referring to FIG. 11, the control circuit 36 of the display of this embodiment comprises ROM 43 having given storage areas. The ROM 43 contains plural pieces of information (timing information) indicative of ON and OFF timings (lighting start point and lighting termination point) of the light source.

The display of this embodiment further comprises a mode setting portion 42 for use in setting of various modes associated with ON timings of the light source. The mode setting portion 42 is connected to the control circuit 36. The mode setting portion 42 is a mode switch comprised of a dip switch, a toggle switch, a dial, or the like. Alternatively, the mode setting portion 42 may be adapted to perform switching among the modes by software.

Since the other elements of the display of this embodiment are identical to those of the first embodiment, the same or corresponding parts are referenced to by the same references, and as such, description will be omitted.

The user who is to use the display so constituted, first, enters a mode associated with desired ON timing with the mode setting portion 42. The modes capable of being entered with the mode setting portion 42 may include "cold district mode", "standard modes", etc. Since the response of the liquid crystal generally becomes slower as temperature decreases as mentioned previously, in the "cold district mode", the ON and OFF timings of the light source are delayed with respect to those of the "standard modes". Instead of the modes according to temperatures, there may be provided modes according to conditions including moisture, ambient brightness, air-pressure, weather, earth magnetism, etc.

Receiving the entered mode, the mode setting portion 42 outputs a signal indicative of the received mode to the control circuit 36. Receiving the signal from the mode setting portion 42, the control circuit 36 selects one timing information among the plural pieces of timing information stored in the ROM 43 in accordance with the received signal. To realize ON timing indicated by the selected timing information, the control circuit 36 outputs a control signal to the back light control circuit 37. As a result, the lighting source is turned ON/OFF according to the mode set by the user.

While in this embodiment one mode is selected among the plurality of modes, desired condition may be selected within a range of continuous numeric values. Besides, the ROM 43 may be a writable memory such as EEPROM, and thereby, the timing information may be suitably changed, added, or otherwise erased by operation of the user. This makes it possible for the user to create desired modes.

(Embodiment 4)

In first to third embodiments, the field sequential color liquid crystal displays have been employed as the displays. On the other hand, a fourth embodiment illustrates a display according to so-called blinking backlight method, which is adapted to perform display by blinking a single light source.

The liquid crystal display panel included in the display of this embodiment has color filters of red, green and blue, differently from the field sequential color method. Also, the backlight included in the display of this embodiment includes a light source for emitting white light.

The light source may be LEDs as in the case of the first embodiment, or may be, of course, any other light sources including fluorescent lamp, cold cathode lamp, and incandescent lamp. Also, the light sources for emitting lights having different prisms, which are employed in the field sequential color method, may be turned ON/OFF simultaneously rather than sequentially turned ON by time division so as to look like as if they were operating as a single-color light source. The light emitted by the light source need not be white but may be red, blue, green, yellow and the like.

In the display so constituted, the backlight is controlled so that white light is ON during a certain period and OFF during the remaining period in one frame period. Such blinking of the light source within one frame period can reduce blur in a moving image in contrast with the case where the light source is continuously ON (e.g., see "Yasuichiro kurita, et. al. 4. Trial to Improve Image Quality of LCD by Intermittent Display" Shingaku Gihou Technical Report of IEICE., EID 2000-47, pp. 13–18 (2000-09)".

Since the other elements of the display of this embodiment are identical to those of the first embodiment, description thereof is omitted.

Subsequently, operation of the display of this embodiment will be described.

Figures 12A, 12B, 12C:
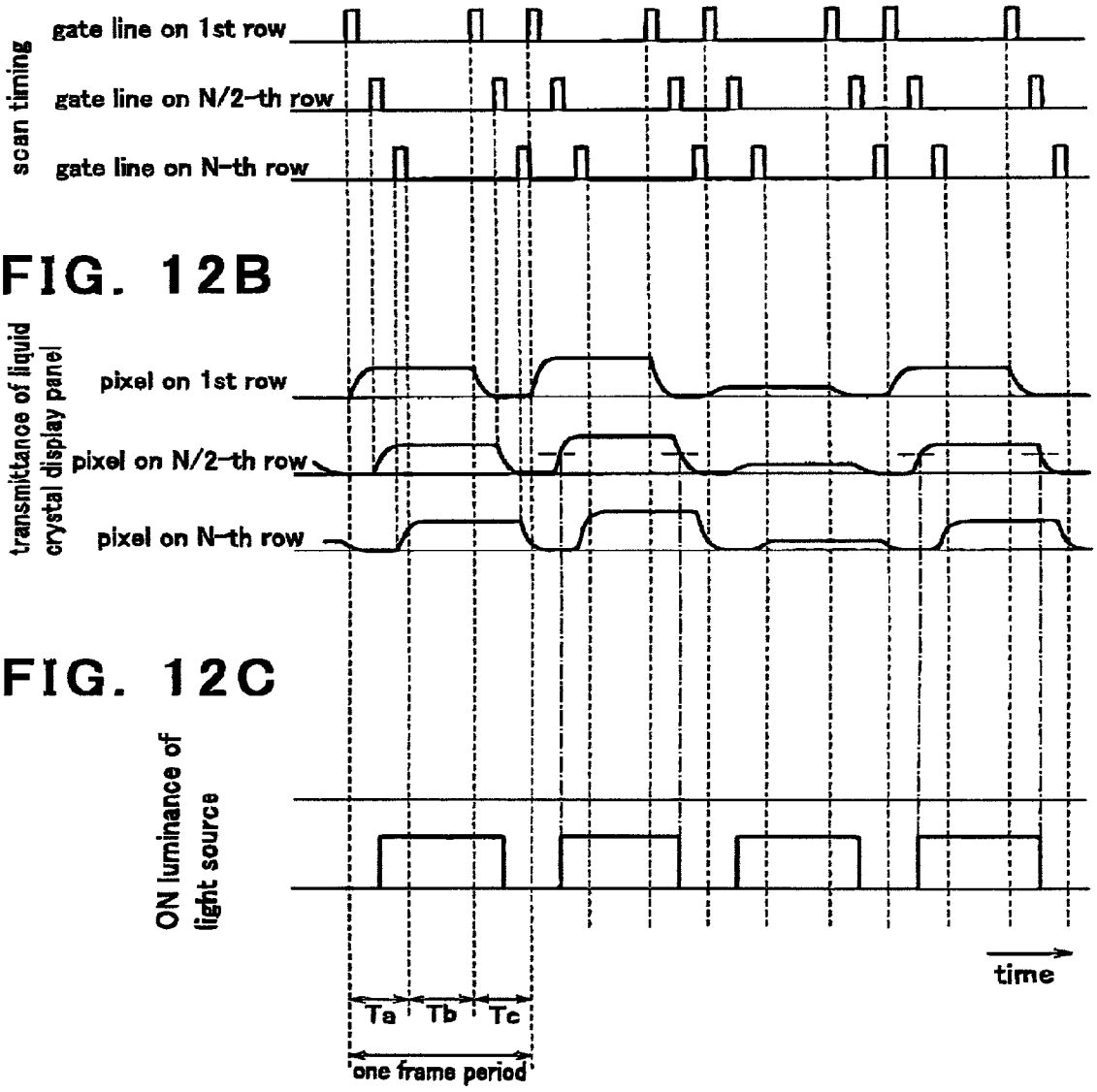

FIGS. 12A–12C are timing charts showing an example of display operation of the display of the fourth embodiment. FIG. 12A shows timings at which scan signals are output to gate lines in a liquid crystal display panel. FIG. 12B shows change in transmittance in pixels on respective rows included in the liquid crystal display panel. FIG. 12C shows change in ON luminance of the light source. Here, one frame period is composed of write period Ta, hold period Tb, and erase period Tc. These Figures illustrate that the liquid crystal display panel has N-row pixels and N-row gate lines corresponding to these pixels.

As shown in FIG. 12A, in the write period Ta, the scan signals are sequentially output to the gate lines on 1st to N-th row. According to timings of the output operation, the video signals are sequentially written onto the pixels on 1st to N-th row, subsequently, in the hold period Tb, the scan signals are not output, and therefore, the video signals written in the write period Ta are held in the respective pixels.

Then, in the erase period Tc, in the same manner as the write period Ta, the scan signals are sequentially output to the gate lines on 1st to N-th rows, and reset signals for resetting the video signals written in the write period Ta, are sequentially written onto the pixels on 1st to N-th rows. FIG. 12B illustrate that the transmittance of the liquid crystal display panel is set to 0, as in the case of FIG. 4B.

As shown in FIG. 12C, the backlight is controlled so that the light source of the backlight is turned ON in the course of rising of the transmittance in pixel on N/2-th row and turned OFF in the course of falling of the transmittance. This makes it possible to suppress the luminance gradient and chroma gradient in the display region, as in the case of the first embodiment. Specifically, the light source is turned ON before the completion of the rising of the transmittance and turned OFF after the start of the falling of the transmittance.

As in the case of the field sequential color method of the first embodiment, it is desirable to satisfy the secondary conditions described in the first embodiment:

[3] The light source is turned ON after the start of rising of the transmittance of the liquid crystal display panel in the pixel on 1st row.

[4] The light source is turned OFF before completion of falling of the transmittance of the liquid crystal display panel in the pixel an N-th row.

It should be remembered that the main purpose of the field sequential color method is to suppress mixed color but the main purpose of this embodiment is to prevent image retention or blur in the moving image due to the event that an image to be displayed in a frame residues in a subsequent frame.

The desired condition for preventing the luminance gradient from being recognized by the viewers is given by the formula (7), as in the case of the first embodiment.

Also, when Twrite≦Tlc is satisfied, the noticeable effects of suppressing the luminance gradient is attained as in the case of the first embodiment.

In addition, the light source may be adapted to emit light as shown in FIG. 8B or 8C, as in the case of the first embodiment.

Further, the display of this embodiment may include the temperature sensor similarly to the second embodiment, for switching ON timing of the light source according to measurements obtained by the temperature sensor. This enables the light source to be turned ON at appropriate timings according to temperatures in the environment where the display is used.

Moreover, as in the case of the third embodiment, the desired ON timings can be set by the user.

(Another Embodiment)

The displays of the above-described embodiments may be used as displays of various types of devices such as monitors for personal computers, television receivers, micro displays, headmount displays, and projectors.

In particular, because the displays of the present invention are capable of satisfactory display even in low-temperature environment, they are suitable as displays of cellular telephones and portable terminal such as PDA (Personal Digital Assistant) which are often used in low-temperature environment.

Figure 13A:
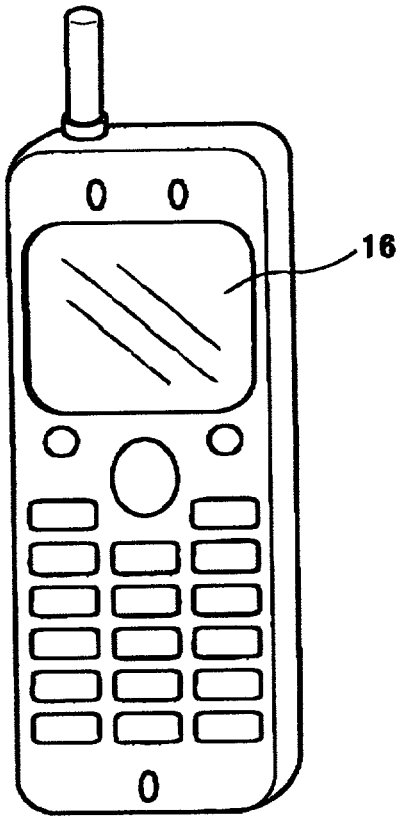
Figure 13B:
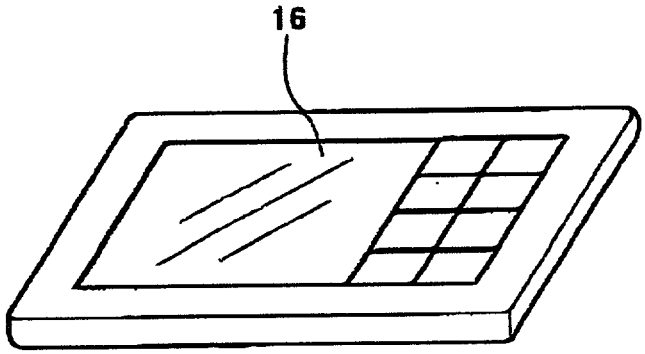
Figures 14A, 14B, 14C:
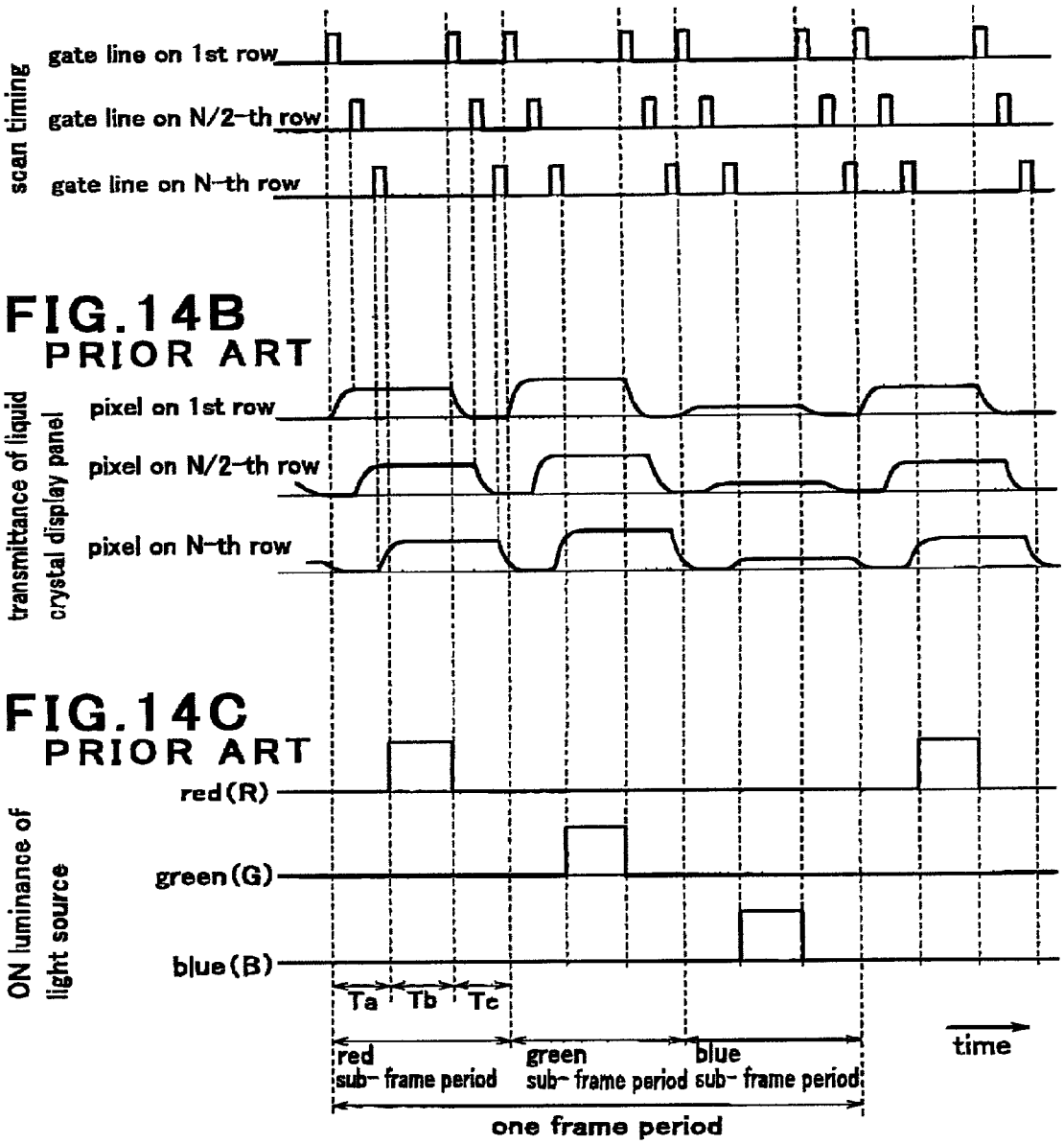
FIG.14A PRIOR ART
FIG.14B PRIOR ART
FIG.14C PRIOR ART

FIGS. 13A, 13B are views showing appearance of devices including the displays of the present invention. FIG. 13A shows a cellular telephone and FIG. 13B shows a portable terminal. Here, reference numeral 16 denotes display portions of these devices. The display portions 16 are comprised of the displays of the above embodiments.

Here, the cellular telephone or the portable terminal respectively output a video signal to the corresponding display portion 16. Receiving the video signal as input, the display portion 16 operates like the displays of the above embodiments. This allows uniform luminance and chroma to be kept in the plane of the display region.

As should be understood, the displays of the present invention and the cellular telephone and the portable terminal including the displays are capable of suppressing the luminance gradient and chroma gradient and displaying satisfactory image.

While in the displays according to the field sequential color method of the present invention, the sub-frame periods are provided in the order of red, green, and blue, the order is not intended to be limited to this. Alternatively, the sub-frame periods may be in any other orders of red, blue, and green, green, blue, and red, etc. Further, a plurality of sub-frame periods may be provided for one color, e.g., red, green, blue, and green.

Also, there may be provided sub-frame periods in which a plurality of light sources are adapted to be ON. By way of example, there may be provided sub-frame periods in which light sources of red, green and blue may be adapted to emit light simultaneously for white display. In actuality, for the purpose of preventing color breaking, or the like, such drive is sometimes carried out. (see e.g., Publication of Unexamined Patent Application No. Hei. 8-101672 or U.S. Pat. No. 5,828,362).

While in the present invention, the ON timings of the light sources way be determined based on the transmittance in the pixel on N/2-th row, as indicated by the conditions [1], [2], but the same effects can be provided even in the case of pixel on row in the vicinity of N/2-th row instead of the pixel on N-th row.

The "pixel on 1st row" in the condition (3) may be replaced by "pixel on row in the vicinity of 1st row" and "pixel on N-th row" in the condition (4) may be replaced by "pixel on row in the vicinity of N-th row", which results in the same effects provided by the present invention.

While in the field sequential color displays, just after the reset signals are written onto the pixels on N-th row in a sub-frame period, the video signals are written onto the pixels on 1st row in a subsequent frame period as shown in FIGS. 4A–4C, the writing operation is not limited to this. As an alternative, after an elapse of a certain time after writing of the reset signals onto the pixels on N-th row, the video signals may be written onto the pixels on 1st row. As an additional alternative, the video signals may be written onto the pixels on 1st row before writing of the reset signals onto the pixels on N-th row. In this case, the erase period Tc in a sub-frame period sometimes overlaps with the write period Ta in a subsequent sub-frame period.

While in the present invention, the gate driver 34 is adapted to sequentially output the scan signals to the gate lines 31 on 1st to N-th row as shown in FIG. 4A, it may be adapted to output the scan signals in the reversed order (from N-th to 1st). Some liquid crystal display panel has gate lines and source lines arranged in the opposite direction of the panel of the present invention, namely, N-column gate lines. In that case, also, the scan signals may be output to the gate lines in either order. Further, the present invention is applicable to so-called interlacing.

Also, the displays of the present invention are not intended to be limited to the active matrix type displays. For example, scanning may be performed with a CMOS-type circuit configuration of FIG. 7 disclosed in Publication of Unexamined Patent Application. No. Hei. 11-38386, or otherwise the displays may be of simple matrix type or MIM (Metal Insulator Metal) type.

Further, the liquid crystal display panel may be of transparent type or reflective type. In case of the reflective type, the above-described embodiments are implemented by using reflectance instead of the transmittance.

Furthermore, the display method of gray scales may be analog method adapted to control gray scales at voltage level of the video signals or digital method disclosed in Publication of Unexamined Patent Application No. Hei. 11-38386.

Moreover, the liquid crystal mode is not limited to OCB. The various types of liquid crystals may be employed, including TN (Twisted Nematic) liquid crystal, STN (Super Twisted Nematic) liquid crystal, ECB (Electric Field Control Birefringence) liquid crystal including homogeneous alignment liquid crystal, bent liquid crystal, IPS (IN-Plane-Switching) liquid crystal, GH (Guest Host) liquid crystal, polymer dispersion type liquid crystal, discotheque liquid crystal, ASV liquid crystal, MVA (MULTI DOMAIN VA) liquid crystal, etc. The liquid crystal having spontaneous polarization, such as ferroelectric liquid crystal or anti-ferroelectric liquid crystal could be used but these liquid crystals are not suitable for use in the portable terminal or he like, because of its less resistivity to shock.

Indeed, it is true that the ferroelectric liquid crystal or the anti-ferroelectric liquid crystal is generally quick in response and its response time Tlc is commonly not larger than 100 μsec, but the present invention provide noticeable effects of suppressing the luminance gradient and the chroma gradient when the response time Tlc is larger than the write period Twrite, as mentioned previously. So, desired effects are difficult to obtain with the use of these liquid crystals because of extreme quickness.

Meanwhile, extremely slow response of the liquid crystal is unwanted. Nevertheless, it is certain that more satisfactory image is attained with the use of such slow liquid crystal in the present invention in contrast with the conventional display. This is caused by the fact that there is sometimes upper limit of the response time Tlc for obtaining satisfactory image. With the use of the TN liquid crystal or the STN liquid crystal, it sometimes happens that the effects of the present invention cannot be effectively obtained, because of their slowness.

In view of the foregoing, in conclusion, it is preferable that the OCB liquid crystal which is relatively slower in response than the ferroelectric liquid crystal but relatively quicker in response than the TN liquid crystal, is used, because the most noticeable effects of the present invention is achieved.

The light modulation medium is not limited to the liquid crystal. For instance, electro-optics crystal such as BSO (bismuth silicon oxide) may be used as the light modulation medium. Any light modulation medium may be used provided that its optical characteristic (e.g., transmittance, reflectance, diffraction efficiency, light absorptance, prisms of transmitted light or reflected light, deflection angle, degree of polarization), varies according to an electric signal. Nevertheless, the liquid crystal is preferable because it is the least expensive and superior in productivity.

Numerous modifications and alternative embodiments of the invention will be apparent to those skilled in the art in the light of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention.

What is claimed is:

1. A display comprising:

a light modulation element including light modulation medium interposed between a pair of opposed substrates and having a display region including a plurality of pixels arranged in a matrix for displaying an image;

an illuminating device having a light source; and a drive portion for driving the light modulation medium by sequentially repeating writing and erasing of a video signal for each pixel to thereby change transmittance of light emitted from the light source in the light modulation element, wherein the light source is turned ON in the course of rising of the transmittance in a pixel located substantially at a center of the display region and the light source is turned OFF in the course of falling of the transmittance in the pixel located substantially at the center of the display region.

2. The display according to claim 1, wherein when point at which the light source is turned ON is represented by T1, transmittance in the pixel located substantially at the center of the display region at the point T1 is represented by M1, point at which the light source is turned OFF is represented by T2, transmittance in the pixel located substantially at the center of the display region at point T2 is represented by M2, a maximum value of the transmittance in the pixel located substantially at the center of the display region in a period during which the light source is ON is represented by M0, and the write period is represented by Twrite, the illuminating device control portion is adapted to control the illuminating device so as to satisfy a formula given by $[|M2-M1|Twrite]/[M0(T2-T1)] \leqq 0.92$.

3. The display according to claim 2, wherein when response time of the liquid crystal is represented by Tlc, $Tlc \geqq Twrite$.

4. The display according to claim 1, wherein one of the pair of substrates is an array substrate having a plurality of gate lines and source lines arranged so as to cross each other;

pixel electrodes respectively provided as corresponding to points at which the plurality of gate lines and the plurality of source lines cross each other;

a plurality of switching devices respectively provided as corresponding to the pixel electrodes, for switching between a conductive state and a non-conductive state between the pixel electrodes and the source lines in accordance with a drive signal supplied through the gate lines, and the other of the pair of substrates is an opposing substrate having a counter electrode disposed opposite to the array substrate.

5. The display according to claim 1, further comprising:

a temperature sensor for measuring temperature of a vicinity of the light modulation element, wherein the illuminating device control portion is adapted to control the illuminating device to cause the light source to be turned ON/OFF according to measurement obtained by the temperature sensor.

6. The display according to claim 1, further comprising a receiving portion for receiving an input for setting of ON timing of the light source, wherein the illuminating device control portion is adapted to control the illuminating device to cause the light source to be turned ON/OFF according to the setting indicated by the input received by the receiving portion.

7. The display according to claim 1, wherein the light modulation medium is liquid crystal.

8. The display according to claim 7, wherein the liquid crystal is OCB-mode liquid crystal.

9. The display according to claim 1, wherein the light source is light-emitting diode.

10. The display according to claim 1, wherein the light source is electroluminescence light-emitting element.

11. The display according to claim 1, wherein one of the pair of substrates has color filters of red, blue, and green.

12. A cellular telephone comprising:

the display according to claim 1, the cellular telephone being adapted to output video signals to the display.

13. A portable terminal comprising:

the display according to claim 1, the portable terminal being adapted to output video signals to the display.

14. A display comprising:

a light modulation element including light modulation medium interposed between a pair of opposed substrates and having a display region including a plurality of pixels arranged in a matrix for displaying an image;

an illuminating device having light sources for emitting lights with different wavelengths; and a drive portion for driving the light modulation medium by seciuentially repeating writing and erasing of video signals for each pixel group to thereby change transmittance of lights emitted from the light sources in the light modulation element, wherein, one frame period of the video signals is composed of a plurality of sub-frame periods, and a light source for emitting light of a specified wavelength is turned ON in the course of rising of the transmittance in the pixel located substantially at the center of the pixel region in each sub-frame period, and a light source is turned OFF in the course of falling of the transmittance in the pixel located substantially at the center in each sub-frame period.

* * * * *

UNITED STATES PATENT AND TRADEMARK OFFICE

CERTIFICATE OF CORRECTION

PATENT NO. : 6,965,367 B2
APPLICATION NO. : 10/108299
DATED : November 15, 2005
INVENTOR(S) : Yukio Tanaka et al.

It is certified that error appears in the above-identified patent and that said Letters Patent is hereby corrected as shown below:

On the title page:

Under item (56) References Cited., add -- OTHER REFERENCE: Y. Kuratomi, et al, 'SUBJECTIVE EVALUATION FOR PICTURE QUALITY OF LCD-TVs" IDW 2000 Proceedings of the 7th International Display Workshop, 3Dp-2, pages 1135-1138 --

Signed and Sealed this

Twenty-second Day of May, 2007

JON W. DUDAS
*Director of the United States Patent and Trademark Office*